US011661833B1

(12) United States Patent
Meier

(10) Patent No.: US 11,661,833 B1
(45) Date of Patent: May 30, 2023

(54) DOWNHOLE SOLIDS SEPARATOR

(71) Applicant: Reynolds Lift Technologies, LLC, Missouri City, TX (US)

(72) Inventor: Kyle Meier, Missouri City, TX (US)

(73) Assignee: Reynolds Lift Technologies, LLC, Missouri City, TX (US)

( * ) Notice: Subject to any disclaimer, the term of this patent is extended or adjusted under 35 U.S.C. 154(b) by 0 days.

(21) Appl. No.: 17/827,615

(22) Filed: May 27, 2022

(51) Int. Cl.
*E21B 43/34* (2006.01)
*E21B 43/36* (2006.01)

(52) U.S. Cl.
CPC ..... *E21B 43/35* (2020.05); *E21B 43/36* (2013.01)

(58) Field of Classification Search
CPC ..... E21B 43/34; E21B 43/35; E21B 43/36; E21B 43/38; E21B 43/385; E21B 43/40
See application file for complete search history.

(56) References Cited

U.S. PATENT DOCUMENTS 4,072,481 A 2/1978 Laval, Jr.
5,314,018 A 5/1994 Cobb
5,516,360 A * 5/1996 Normandeau ..... F04D 9/003 96/217
5,682,957 A * 11/1997 Lyon ..... E21B 21/002 175/231
5,810,081 A 9/1998 Cobb et al.
6,167,960 B1 1/2001 Moya
6,189,613 B1 * 2/2001 Chachula ..... E21B 43/35 166/265
6,382,317 B1 5/2002 Cobb
7,967,991 B2 6/2011 Lecoffre et al.
8,511,390 B2 8/2013 Coyle et al.
8,617,405 B2 12/2013 Hopper
8,925,637 B2 1/2015 Coyle et al.
9,045,980 B1 6/2015 Botts
9,127,535 B2 9/2015 Coyle et al.
9,249,653 B1 2/2016 Botts
9,359,879 B2 6/2016 Gill et al.
9,714,561 B2 7/2017 Hopper
10,107,088 B2 10/2018 Stachowiak et al.
10,605,064 B1 3/2020 Raglin
10,905,803 B2 * 2/2021 Minskoff ..... A61M 1/88
11,199,080 B2 12/2021 Raglin
2005/0173336 A1 * 8/2005 Arnaud ..... E21B 43/129 210/512.1
2008/0210417 A1 9/2008 Ford
2008/0283301 A1 * 11/2008 Sherwood ..... E21B 43/34 175/66

(Continued)

FOREIGN PATENT DOCUMENTS

WO 2011079218 A2 6/2011

OTHER PUBLICATIONS

"SiO2 Slayer™—Downhole Solids Separator", RLT Technical Presentation, 2018 Reynolds Lift Technologies, 6 pages.

*Primary Examiner* — Shane Bomar
(74) *Attorney, Agent, or Firm* — Ditthavong, Steiner & Mlotkowski

(57) ABSTRACT

Provided are an apparatus, method, and system for separating solids from fluids, particularly in a downhole environment. The separator apparatus comprises a vortex inducer and a solids collection conduit. The separator apparatus can be mounted in a cylindrical housing for attachment to downhole piping for removal of solids in fluid flowing to other equipment.

17 Claims, 12 Drawing Sheets

(56) References Cited

U.S. PATENT DOCUMENTS

| | | | | |
|---|---|---|---|---|
| 2009/0242490 | A1 | 10/2009 | Hopper | |
| 2013/0134108 | A1* | 5/2013 | Howard | E21B 43/35 210/512.1 |
| 2013/0327727 | A1* | 12/2013 | Hopper | B04C 5/103 166/368 |
| 2017/0266586 | A1* | 9/2017 | Hopper | B01D 19/0057 |
| 2018/0195375 | A1* | 7/2018 | Xiao | E21B 43/38 |
| 2019/0024491 | A1* | 1/2019 | Fielder | E21B 43/38 |
| 2019/0085676 | A1* | 3/2019 | Downing | E21B 43/08 |
| 2022/0243564 | A1* | 8/2022 | Tang | E21B 43/40 |

* cited by examiner

DOWNHOLE SOLIDS SEPARATOR

FIELD OF THE INVENTION

This disclosure relates to apparatus, and methods and systems using such apparatus, for separation of solids from a fluid. In particular, the apparatus employs centrifugal force to separate sand and other solids from well fluids in a downhole environment.

BACKGROUND OF THE INVENTION

Petroleum wells can be naturally flowing, injecting, or can be produced by any means of artificial lift. Artificial lift is a process utilized to lift well fluids to surface from a wellbore when the natural drive energy of the reservoir is not strong enough to push the oil to the surface. During the production of these wellbore fluids, solids may be entrained in the fluid that may pose a risk to the downhole production equipment. These downhole production equipment components may comprise of centrifugal pumps, motors, plungers, barrels, valves, and sealing arrangements which are susceptible to erosion and failure due to solids in the production fluid.

A particulate separator positioned within a shell of a wellbore of a hydrocarbon production well to separate particulate matter from a fluid mixture and direct the separated particulate matter away from a pump intake of an artificial lift to inhibit the particulate matter from entering the pump intake, which may increase the efficiency and/or the service life of the downhole assembly.

A need still exists for solids removal devices and methods having higher reliability and improved efficiency. Ideally, improved solids removal devices and methods could be implemented using economical starting materials, commonly used equipment, and familiar fabrication techniques.

SUMMARY OF THE INVENTION

The present disclosure provides apparatus, methods, and systems for separating solids from fluids, particularly in a downhole environment. Apparatus, methods, and systems herein are useful for a broad range of fluid flow rates and intermittent or continuous fluid flow.

In some embodiments, a separator apparatus for removing solids from an untreated fluid comprises a vortex inducer and a solids collection conduit. The vortex inducer comprises one or more helical apertures and a central aperture. The solids collection conduit is connected to the vortex inducer to form a separation chamber. The one or more helical apertures are positioned to deliver a helical flow of untreated fluid to the separation chamber proximate to an inner surface of the solids collection conduit. The central aperture is positioned to withdraw a treated fluid from the separation chamber proximate to a central axis of the separation chamber. In some embodiments, the vortex inducer comprises a shell element and a core element, and the one or more helical apertures are formed at an interface between a cylindrical inner surface of the shell element and a cylindrical outer surface of the core element.

In some embodiments, the cylindrical outer surface of the core element is radially spaced from the central aperture, and the cylindrical inner surface of the shell element comprises one or more helical channels. The core element is slidably joined to the shell element by an overlap of at least a portion of the cylindrical outer surface of the core element and at least a portion of the cylindrical inner surface of the shell element. One or more helical apertures are formed proximate to the overlap by the one or more helical channels and the cylindrical outer surface of the core element.

In some embodiments, the cylindrical outer surface of the core element is radially spaced from the central aperture and comprises one or more helical channels. The core element is slidably joined to a shell element by an overlap of at least a portion of the cylindrical outer surface of the core element and at least a portion of the cylindrical inner surface of the shell element. One or more helical apertures are formed proximate to the overlap h the one or more helical channels and the cylindrical outer surface of the core element.

In some embodiments, a downhole module comprises a housing, a separator apparatus, an upper housing closure, and a treated fluid discharge conduit. The separator apparatus is mounted within the housing forming an upper space within the housing and above the separator apparatus and a lower space within the housing and below the separator apparatus. The treated fluid discharge conduit is connected to the vortex inducer at its lower end and the upper housing closure at its upper end. The treated fluid discharge conduit fluidly connects the central aperture to an opening in the upper housing closure. The upper housing closure, the treated fluid discharge conduit, and the separator apparatus are connected forming a feed chamber. The feed chamber is fluidly connected to the one or more helical apertures and one or more inlet ports through the housing.

In some embodiments, a method for separating solids from an untreated fluid comprises: submerging a downhole module in an untreated fluid having a first solids content; and reducing the pressure inside the treated fluid discharge conduit relative to the pressure outside the downhole module to induce flow of untreated fluid through the one or more inlet ports to the feed chamber, and from the feed chamber through the vortex inducer to the separation chamber. The flow of untreated fluid through the vortex inducer creates a velocity of untreated fluid in the one or more helical apertures, wherein the velocity has a tangential component and an axial component. The tangential component of velocity of untreated fluids exiting the one or more helical apertures creates a vortex in the separation chamber wherein centrifugal force concentrates solids proximate to the inner surface of the solids collection conduit and creating a treated fluid having a second solids content proximate to the central axis of the separation chamber, wherein the second solids content is less than the first solids content.

In some embodiments, a method for separating solids from an untreated fluid comprises: adding an untreated fluid comprising a first solids content to a cylindrical space having an outer diameter in the range of from 2 inches (5.1 cm) to 6 inches (15.2 cm); inducing a vortex in the cylindrical space, wherein the vortex has a tangential velocity of at least 100 ft/sec (30 m/sec) near the diameter of the cylindrical space; separating the untreated fluid into a high solids component near the outer diameter of the cylindrical space and a treated fluid having a second solids content; withdrawing the treated fluid from the cylindrical space; and withdrawing the solids component from the cylindrical space.

The foregoing has outlined rather broadly the features and technical advantages of the present invention in order that the detailed description of the invention that follows may be better understood. Additional features and advantages of the invention will be described hereinafter, which form the subject matter of the claims of the invention. It should be appreciated by those skilled in the art that the conception and specific embodiments disclosed may be readily utilized as a basis for modifying or designing alternate structures and/or other processes for carrying out the same purposes of the present invention. It should also be realized by those skilled in the art that such equivalent constructions do not depart from the spirit and scope of the invention as set forth in the appended claims. The novel features which are believed to be characteristic of the invention, both as to its structure, method of manufacture, and method of use, together with further objects and advantages will be better understood from the following description.

BRIEF DESCRIPTION OF THE DRAWINGS

The claimed subject matter may be understood by reference to the following description taken in conjunction with the accompanying drawings, in which like reference numerals identify like elements, and in which:

Figure 1:
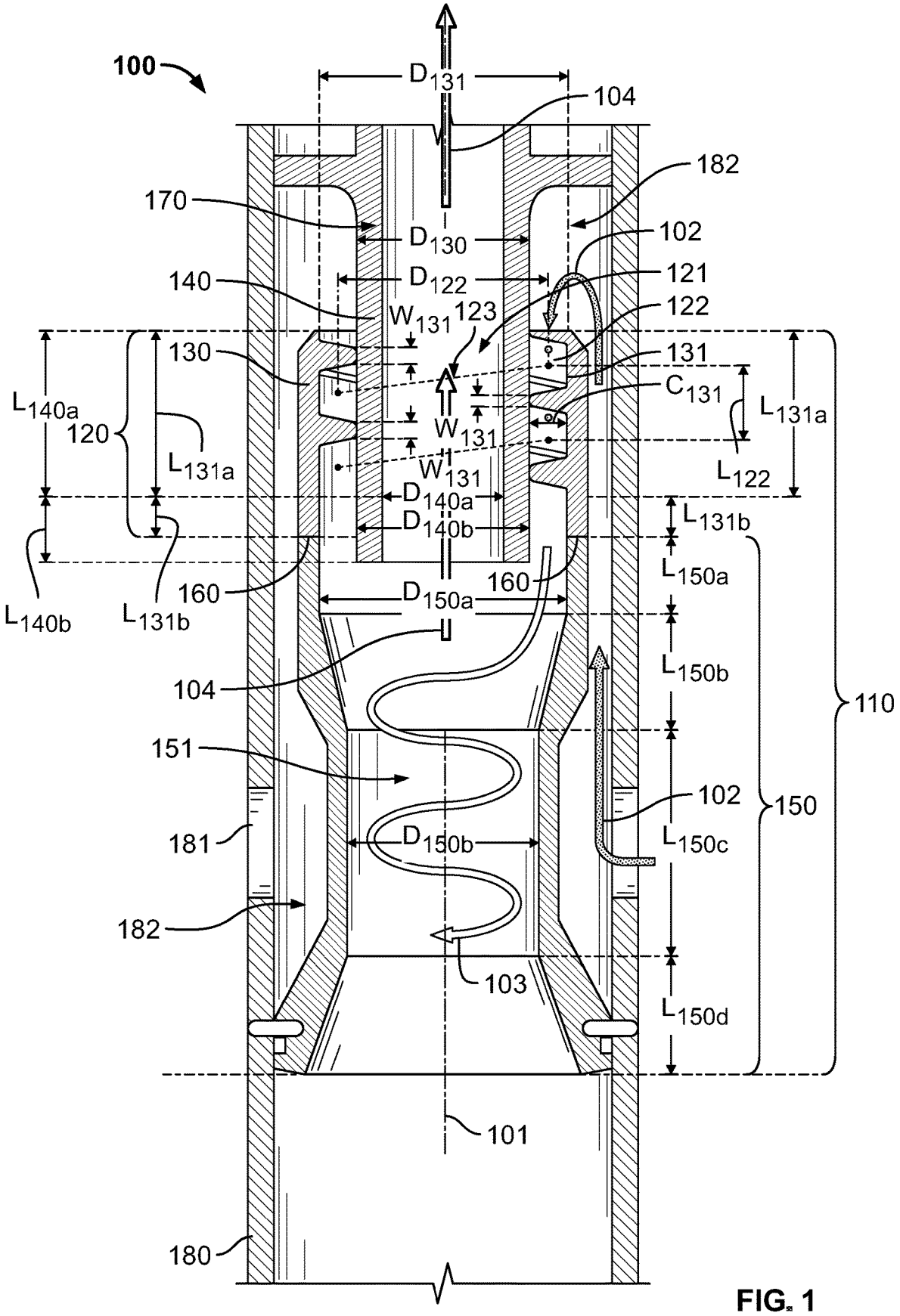
FIG. 1 is a cross-sectional drawing of a first embodiment of a downhole module comprising the separator apparatus described herein.

While the disclosed apparatus, process, and system are susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the subject matter claimed below will now be disclosed. In the interest of clarity, some features of some actual implementations may not be described in this specification. It will be appreciated that in the development of any such actual embodiments, numerous implementation-specific decisions must be made to achieve the developer's specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than the broadest meaning understood by skilled artisans, such a special or clarifying definition will be expressly set forth in the specification in a definitional manner that provides the special or clarifying definition for the term or phrase.

For example, the following discussion contains a non-exhaustive list of definitions of several specific terms used in this disclosure (other terms may be defined or clarified in a definitional manner elsewhere herein). These definitions are intended to clarify the meanings of the terms used herein. It is believed that the terms are used in a manner consistent with their ordinary meaning, but the definitions are nonetheless specified here for clarity.

Definitions

"Core element," as used herein, means the inner central component of the vortex inducer.

"Feed chamber," as used herein, means a chamber enclosed by the connection of the separator apparatus, the treated fluid discharge conduit, and the housing.

"Fluidly connected," as used herein, means a connection of spaces, chambers, and/or apertures that facilitates the flow of fluid directly from a first space, chamber, and/or aperture to a second space, chamber, and/or aperture, which is directly adjacent to the first space, chamber, and/or aperture.

"Helical aperture," as used herein, means an aperture formed at the interface of a shell element and a corresponding core element by a) a helical channel in the cylindrical inner surface of the shell element and the cylindrical outer surface of a corresponding core element, or b) a helical channel in the cylindrical outer surface of a core element and the cylindrical inner surface of the shell element.

"Housing," as used herein, means a cylindrical body to which the separator apparatus disclosed herein is attached in a downhole module.

"Inlet port," as used herein, mean an opening through the housing wall to permit untreated fluid to flow from outside the housing into the feed chamber.

"Separation chamber," as used herein, means the space defined by the attachment of the vortex inducer to the solids collection conduit.

"Shell element," as used herein, means the outer component of the vortex inducer.

"Solids collection conduit," as used herein, means a substantially cylindrical vertical wall located below the vortex inducer.

"Treated fluid discharge conduit," as used herein, means a pipe or other tubular means fluidly connecting the upper end of the central aperture to an opening in an upper housing closure.

"Treated fluid," as used herein, means a fluid produced after a treated fluid flows through the separator apparatus disclosed herein.

"Untreated fluid," as used herein, means a fluid having a content of suspended solids prior to being fed through the separator apparatus disclosed herein. Such fluid can be water, hydrocarbon, or a mixture thereof.

Directional terms such as "above," below," "upper," "lower," and the like are not limiting and are provided only to aid in describing the orientation and relative position of components of the separator apparatus and the downhole module with respect to one another when the separator apparatus and the downhole module are in the vertical position as shown in FIGS. 1-6.

Separator Apparatus

Disclosed herein is a separator apparatus for separating solids from fluids such as, but not limited to, water, liquid hydrocarbon, or a mixture thereof. The separator apparatus is particularly suited for operation in a downhole environment in oil and gas operations but could also be useful for other situations where it is desirable to remove or reduce solids content of fluid flowing into a pump and/or other mechanical equipment.

The separator apparatus comprises a vortex inducer and a solids collection conduit. The vortex inducer comprises a central aperture proximate to the central axis of the vortex inducer. The vortex inducer further comprises one or more helical apertures separate from the central aperture and separate from one another. The one or more helical apertures are radially spaced from the central aperture, and the axis of the helix formed by each helical aperture coincides with the central axis of the vortex inducer. In some embodiments, the vortex inducer comprises two or more, three or more, or four or more helical apertures separate from the central aperture and separate from one another.

In some embodiments, the solids collection conduit comprises a substantially cylindrical wall that is a vertical wall, a frustoconical wall with decreasing diameter from the upper end to the lower end of such section, a frustoconical wall with increasing diameter from the upper end to the lower end of such section, or a combination thereof. In some embodiments, the solids collection conduit comprises at least one section that is substantially vertical and at least one section that is frustoconical with decreasing diameter from the upper end to the lower end of such section. In some embodiments, the solids collection conduit comprises at least one section that is substantially vertical and at least one section that is frustoconical with increasing diameter from the upper end to the lower end of such section. In some embodiments, the solids collection conduit comprises at least one section that is substantially vertical, at least one section that is frustoconical with decreasing diameter from the upper end to the lower end of such section, and at least one section that is frustoconical with increasing diameter from the upper end to the lower end of such section. In each such embodiment the sections are connected in a manner to form a substantially cylindrical wall, which is a fluid barrier with an opening at the upper end formed by the upper edge of the substantially cylindrical wall and an opening at the lower end formed by the lower edge of the substantially cylindrical wall.

The upper end of the solids collection conduit is connected to the lower end of the vortex inducer forming a separation chamber. The upper end of the separation chamber is fluidly connected to a central aperture and one or more helical apertures, and the lower end of the central aperture and the lower end(s) of the one or more helical apertures are the only openings at the upper end of the separation chamber. The only opening at the lower end of the solids separation chamber is defined by the lower edge of the substantially cylindrical wall.

In operation, the upper end of the central aperture is separated from the upper end(s) of the one or more helical apertures by the treated fluid discharge conduit. The upper end of the central aperture is operated at a lower pressure than the pressure at the upper end of the one or more helical apertures. In some embodiments, the difference in pressure between the upper end of the central aperture and the pressure at the upper end of the one or more helical apertures is greater than or equal to 10 psig (69 kPa), greater than or equal to 20 psig (138 kPa), greater than or equal to 30 psig (207 kPa), or greater than or equal to 40 psig (276 kPa). Such pressure differential can be constant or intermittent, based on the type of pump used in the relevant operations. Such pump types include, but are not limited to, centrifugal pumps, vertical pumps, and rotary, reciprocating, or pneumatic displacement or positive displacement pumps.

In some embodiments, maximum flow rates can range from as low as 100 B/D (16 $m^3$/D), 200 B/D (32 $m^3$/D), 500 B/D (79 $m^3$/D), or 1000 B/D (159 $m^3$/D), to as high as 4,000 B/D (636 $m^3$/D), 5,000 B/D (795 $m^3$/D), 7,000 B/D (1,113 $m^3$/D), or 10,000 B/D (1,590 $m^3$/D). In some embodiments, a preferred flow rate for a separator apparatus is based on selected range of calculated flow velocity and/or calculated Reynolds number in the one or more helical apertures. In some applications, operating temperatures of the separator apparatus are in the range of from 70° F. (21° C.) to 220° F. (104° C.) or from 100° F. (38° C.) to 200° F. (93° C.).

The pressure differential discussed above causes untreated fluid to be drawn into the upper end of the one or more helical apertures, wherein static pressure of untreated fluid prior to entering the one or more helical apertures is converted to dynamic pressure based on the velocity of untreated fluid in the one or more helical apertures. The velocity of the untreated fluid in the one or more helical apertures has a component tangential to the circumference of the helical aperture and a component downwardly in the axial direction. The tangential velocity of the untreated fluid exiting the lower end of the one or more helical apertures creates a vortex in the separation chamber, wherein a centrifugal force concentrates the suspended solids to be concentrated on the cylindrical inner surface or wall of the solids collection conduit. As these concentrated solids are pushed to the wall of the solids collection conduit by the centrifugal force, the concentrated solids are moved downwardly to an opening at the lower end of the solids collection conduit by gravity and/or the axial velocity created by the flow through the one or more helical apertures. In some embodiments, the shape of the solids collection conduit, based on the arrangement of one or more vertical sections and/or one or more frustoconical sections, aids in the downward movement of the solids being collected, while preventing backflow of the collected solids in an upward direction, or a combination thereof.

Each of the one or more helical apertures has a uniform cross-sectional area perpendicular to a helical line passing through the centroid of the cross-sectional area. A line tangent to the helical line forms a helix angle θ with the central axis of the vortex inducer based on the rotation of the tangent line and the central axis about a radial line passing through the tangent line and the central axis of the helix and the vortex inducer. If the velocity of the untreated fluid in the helical aperture is u, then the tangential component of the velocity is u(sin θ) and the downward axial component of the velocity is u(cos θ). In some embodiments, the helix angle θ is greater than or equal to 10°, greater than or equal to 20°, greater than or equal to 30°, greater than or equal to 40°, greater than or equal to 50°, or greater than or equal to 60°. In some embodiments, helix angle θ is less than or equal to 80°, less than or equal to 70°, less than or equal to 60°, less than or equal to 50°, less than or equal to 40°, or less than or equal to 30°. In some embodiments, helix angle θ is in the range of from 20° to 80°, from 30° to 70°, from 40° to 65°, or from 45° to 60°.

In other embodiments, the helix angle, the cross-sectional area of the one or more helical apertures, or a combination thereof. Improved machining processes, certain casting processes, and 3D printing enable varying the helix angle in a helical aperture to produce a progressively increasing or decreasing helix lead or pitch in the direction of fluid flow in the vortex inducer. Improved machining processes, certain casting processes, and 3D printing enable varying the cross-sectional area of a helical aperture angle in a helical aperture to produce a progressively increasing or decreasing cross-sectional area in a helical aperture in the direction of fluid flow in the vortex inducer.

Such concentration of solids on the wall of the solids collection conduit results in treated fluid, having a reduced solids content, proximate to the central axis of the separator apparatus. The lower pressure at the upper end of the central aperture causes the treated fluid to flow upwardly into the central aperture, where it will be routed to the suction of a pump or the like.

In some embodiments, each of the one or more helical apertures has a uniform cross-sectional area. Without wishing to be bound by any particular theory, it is believed that the uniform cross-sectional area of the helical apertures in combination with the profile of the wall of the separation chamber provides removal of a higher percentage of solids than is possible from previous separators utilizing helical or cyclonic flows of untreated fluid. The uniform cross-sectional area of the one or more helical apertures produces higher velocities, higher Reynolds numbers, and/or more controlled flow into the solids collection conduit, resulting in less back-mixing of solids into the center of the vortex formed in the solids collection conduit.

In some embodiments, the vortex inducer, having a central aperture and one or more helical apertures having a uniform cross-sectional area, is formed by slidable engagement of a shell element and a core element, wherein the inner diameter of the shell element is equal to or substantially equal to the outer diameter of the core element.

In some embodiments, at least a portion of the inner surface of the shell element comprises one or more helical channels and at least a portion of the core element has a uniform outer diameter. When slidably engaged, at least a portion of the outer surface of the core element and the inner surface of the shell element having the one or more helical channels overlap forming the one or more helical apertures.

In some embodiments, at least a portion of the outer surface of the core element comprises one or more helical channels and at least a portion of the shell element has a uniform inner diameter. When slidably engaged, at least a portion of the inner surface of the shell element and the outer surface of the core element having the one or more helical channels overlap forming the one or more helical apertures.

Another aspect of the separator apparatus disclosed herein is that wear surfaces, or surfaces subject to abrasion wear from high velocity solids, are isolated from axial loads produced by downhole piping. Some commercially available separator devices utilize helical flow to separate suspended solids from fluids in downhole environments. However, although the flow of solids is at a lower velocity, such flow of solids impinges on the inner diameter of the housing for such separator devices. Abrasive wear causes thinning of the wall of the housing, and in some cases, thinning to the point of structural failure of the housing, requiring suspension of operations to remove the downhole piping from the well and then retrieval of the failed equipment from the wellbore. The separator apparatus disclosed herein is mounted within the housing but is separate from the housing, such that the housing is shielded from wear from flowing solids. This prevents the aforementioned structural failure of the housing resulting in unplanned loss of production or other shutdown of operations. Isolation of wear to the separator apparatus disclosed herein produces a failure mode of reduced or efficiency of solids removal instead of structural failure.

In some embodiments, the shell element, the core element, the solids collection conduit, or a combination thereof, are fabricated from and/or coated with a material that is resistant to wear by abrasion from the flow of solids through the separator apparatus. Since the separator apparatus is a small part of the overall downhole module, use of more costly materials of construction and/or coating can be cost effective, especially where structural failure of the housing might be prevented in harsher environments (corrosive environment and/or higher solids content). Many abrasion-resistant metals are available for fabrication of the shell element, the core element, the solids collection conduit, or a combination thereof. Alloys like carbon, manganese, nickel, chrome, and boron are added in different proportions to increase metal hardness and improve resistance to wear from abrasion form flowing solids, such as, but not limited to sand. Tungsten carbide and various grades of stainless steel are suitable materials of construction for the shell element, the core element, the solids collection conduit, or a combination thereof. Stainless steel can be selected for some applications where corrosion is a concern during operation, such as, but not limited to corrosion resulting from high levels of sulfur and/or carbon-dioxide. Stainless steel can be selected from one or more of austenitic stainless steel, ferritic stainless steel, duplex stainless steel, and martensitic and precipitation hardening stainless steel. SAE Type 630 stainless steel, more commonly known as 17-4 PH, is a grade of martensitic precipitation hardened stainless steel useful for fabrication of components of the separator apparatus subject to abrasion from flowing solids. Also suited for fabrication of components of the separator apparatus subject to abrasion from flowing solids are certain austenitic nickel-chromium-based superalloys (e.g., Inconel™, available from voestalpine Specialty Metals, Houston, Tex.) are oxidation-corrosion-resistant materials well suited for service in extreme environments subjected to pressure and heat and have high-temperature strength derived by solid solution strengthening or precipitation hardening, depending on the alloy.

In some embodiments, materials of construction of the shell element, the core element, the solids collection conduit, or a combination thereof, are selected by hardness and/or tensile strength as indirect indicators of abrasion resistance, such as one or more of Rockwell C hardness, Brinell hardness, Vickers hardness, and tensile strength. In some embodiments, a selected metal has a Rockwell C hardness of greater than or equal to 30, greater than or equal to 35, or greater than or equal to 40. In some embodiments, a selected metal has a Brinell hardness of greater than or equal to 285, greater than or equal to 325, or greater than or equal to 375. In some embodiments, a selected metal has a Brinell hardness of greater than or equal to 285, greater than or equal to 325, or greater than or equal to 375. In some embodiments, a selected metal has a Vickers hardness of greater than or equal to 300, greater than or equal to 345, or greater than or equal to 390. In some embodiments, a selected metal has a tensile strength of greater than or equal to 140,000 psi (965 MPa), greater than or equal to 160,000 psi (1,100 MPa), or greater than or equal to 220,000 psi (1500 MPa).

In some embodiments, the shell element, the core element, the solids collection conduit, or a combination thereof, are coated with wear resistant materials such as, but not limited to, ceramics, chemical vapor diamond film, or physical vapor deposition of a hydrogen-free diamond like carbon films (e.g., Tetrabond™, available from IonBond US, Duncan, S.C.).

In an embodiment, an apparatus for separating solids from fluids, comprises a vortex inducer physically connected to a solids collection conduit, forming a chamber, wherein the vortex inducer comprises a helical aperture and a central aperture, and the chamber is fluidly connected to the helical aperture and the central aperture. In further embodiments, the helical aperture is configured to accept a flow of an untreated fluid into the apparatus, and the central aperture is configured to permit withdrawal of a treated fluid.

Certain Embodiments

In some embodiments, a separator apparatus for removing solids from an untreated fluid comprises a vortex inducer and a solids collection conduit. The vortex inducer comprises one or more helical apertures and a central aperture. The solids collection conduit is connected to the vortex inducer to form a separation chamber. The one or more helical apertures are positioned for delivering a helical flow of an untreated fluid to the separation chamber proximate to the inner surface of the solids collection conduit. The central aperture is positioned for withdrawing a treated fluid from the separation chamber proximate to a central axis of the separation chamber. In certain embodiments, each helical aperture has a uniform cross-sectional area perpendicular to a helical line passing through the centroid of the cross-sectional area of each helical aperture, which can be characterized by one or more of the following:

a) a line tangent to the helical line forms a helix angle θ with the central axis of the vortex inducer is: 1) greater than or equal to 10°, greater than or equal to 20°, greater than or equal to 30°, greater than or equal to 40°, greater than or equal to 50°, or greater than or equal to 60°; 2) less than or equal to 80°, less than or equal to 70°, less than or equal to 60°, less than or equal to 50°, less than or equal to 40°, or less than or equal to 30°; or in the range of from 10° to 80°, from 20° to 70°, from 30° to 60°, or from 40° to 50°;

b) the uniform cross-sectional area is sized to produce a velocity in the one or more helical apertures of at least 15 meters/sec, at least 23 meters/sec, at least 31 meters/sec, at least 38 meters/sec, or at least 46 meters/sec at a design flow rate of the separator apparatus; and c) the uniform cross-sectional area is sized to produce a Reynolds number in the one or more helical apertures of greater than or equal to 100,000, 200,000, 300,000, 400,000, or 500,000 at a design flow rate of the separator apparatus.

In some embodiments, in addition to the foregoing, the vortex inducer comprises a shell element and a core element. The one or more helical apertures are at an interface between a cylindrical inner surface of the shell element and a cylindrical outer surface of the core element. In further embodiments, one or more of the core element, the shell element, and the solids collection conduit are further characterized by one or more of:

a) having a surface with a Rockwell C hardness of greater than or equal to 30, a surface with a Brinell hardness of greater than or equal to 285, a surface with a Vickers hardness of greater than or equal to 300, a tensile strength (yield) of greater than or equal to 965 MPa, or a combination thereof;

b) being fabricated from stainless steel; and c) having one or more wear surfaces with a ceramic coating.

In a first set of embodiments, wherein the vortex inducer comprises a shell element and a core element, the cylindrical outer surface of the core element is radially spaced from the central aperture, and the cylindrical inner surface of the shell element comprises one or more helical channels. The core element is slidably joined to the shell element by an overlap of at least a portion of the cylindrical outer surface of the core element and at least a portion of the cylindrical inner surface of the shell element, and the one or more helical apertures are formed proximate to the overlap by the one or more helical channels and the cylindrical outer surface of the core element.

In a second set of embodiments, wherein the vortex inducer comprises a shell element and a core element, the cylindrical outer surface of the core element is radially spaced from the central aperture and comprises one or more helical channels, and the core element is slidably joined to the shell element by an overlap of at least a portion of the cylindrical outer surface of the core element and at least a portion of the cylindrical inner surface of the shell element. The one or more helical apertures are formed proximate to the overlap by the one or more helical channels and the cylindrical inner surface of the shell element.

Downhole Module

In some embodiments, a downhole module comprises a separator apparatus, a treated fluid discharge conduit, a housing, an upper housing closure, and optionally, a lower housing closure. The housing is a section of pipe, tubing, or other cylindrical body that is suitable for vertical or substantially vertical installation or use proximate to the lower end of piping in a wellbore, wherein such piping will be used to draw liquids from the well to the surface. The following discussion will refer to such vertical or substantially vertical orientation of the downhole module for convenience in order to describe the arrangement of components of the downhole module more clearly with respect to one another.

The separator apparatus is mounted within the housing in a manner suitable to divide the space inside the housing into an upper space, which is the space above the separator apparatus within the housing, and a lower space, which is the space below the separator apparatus within the housing. A treated fluid discharge conduit is connected at its lower end such that the space inside the treated fluid discharge conduit is fluidly connected to the central aperture of the separator apparatus. The treated fluid discharge conduit is connected at its upper end to the upper housing closure. The upper housing closure is further connected to the upper end of the housing such that a portion of the above-mentioned upper space is enclosed by the housing, the upper housing closure, the separator apparatus, and the treated fluid discharge conduit forming a feed chamber. The portion of the housing defining the feed chamber comprises one or more inlet ports through the housing, such that the feed chamber is fluidly connected to the space outside the housing by the one or more inlet ports and the one or more helical apertures at the upper end of the separator apparatus. The upper housing closure has at least one opening such that the treated fluid discharge conduit fluidly connects the central aperture of the separator apparatus to the at least one opening in the upper housing closure. The treated fluid discharge conduit further serves to separate the upper end of the one or more helical apertures of the separator apparatus from the upper end of the central aperture of the separator apparatus. The size and number of inlet ports and the size of the feed chamber are selected such that neither will unduly limit flow through the downhole module at the desired flowrate, which can be determined by known methods by one of ordinary skill in the art.

The aforementioned lower space below the separator apparatus is for collection and/or storage of solids removed by the separator apparatus when the downhole module is in operation. The optional lower housing closure encloses the lower end of the housing and separates the lower space inside the housing from the environment outside the housing and also provides for containment of removed solids. The length of the housing below the separator apparatus can be sized based on the estimated rate of solids removal and the time for which such removal rate is to be maintained, both of which can be determined by known methods by one of ordinary skill in the art having knowledge of the location of the intended operations.

Solids Removal Method

In some embodiments, removal of solids from an untreated fluid is accomplished by: accelerating an untreated fluid to a velocity in one or more helical apertures by inducing a pressure drop across the one or more helical apertures, wherein each aperture has an inlet and an outlet; directing the untreated fluid exiting the outlet of each of the one or more helical apertures into a conduit at a downward angle; converting the flow of untreated fluid from an angular flow to a helical flow by containing the flow within the solids collection conduit, wherein centrifugal force induced by the helical flow concentrates a portion of the solids proximate to an inner surface of the conduit; and withdrawing from a central portion of the conduit a treated fluid, wherein the treated fluid has a lower content of solids than the untreated fluid.

In some embodiments, a method for separating solids from an untreated fluid comprises submerging a downhole module, comprising a separator apparatus as disclosed herein in an untreated fluid having a first solids content, and reducing the pressure inside the treated fluid discharge conduit relative to the pressure outside the downhole module to induce flow of untreated fluid through the one or more inlet ports to the feed chamber, and from the feed chamber through the vortex inducer to the separation chamber. The induced flow of untreated fluid through the vortex inducer creates a velocity of untreated fluid in the one or more helical apertures having a tangential component and an axial component. The tangential component of velocity of untreated fluids exiting the one or more helical apertures creates a vortex in the separation chamber wherein centrifugal force concentrates solids proximate to the inner surface of the solids collection conduit resulting in creation of a treated fluid having a second solids content proximate to the central axis of the separation chamber, wherein the second solids content is less than the first solids content. In some embodiments, the method further comprises withdrawing the treated fluid through a treated fluid discharge conduit, withdrawing the concentrated solids from the solids collection conduit through gravity and/or the axial component of velocity, or a combination thereof. In some embodiments, the tangential velocity is sufficient to produce a ratio of the second solids content to the first solids content of less than or equal to 0.05, less than or equal to 0.04, less than or equal to 0.03, less than or equal to 0.02, or less than or equal to 0.01.

More generally, a method disclosed herein for separating solids from an untreated fluid comprises:

a) adding an untreated fluid comprising a first solids content to a cylindrical space having an outer diameter in the range of from 2 inches (5.1 cm) to 6 inches (15.2 cm);
b) inducing a vortex in the cylindrical space, wherein the vortex has a tangential velocity of at least 100 ft/sec (30 m/sec) near the diameter of the cylindrical space;
c) separating the untreated fluid into a high solids component near the outer diameter of the cylindrical space and a treated fluid having a second solids content;
d) withdrawing the treated fluid from the cylindrical space; and
e) withdrawing the solids component from the cylindrical space.

In some embodiments, the cylindrical space is circumscribed by a cylindrical body comprising one or more sections of pipe, one or more fittings, one or more fabricated components, or a combination thereof. In some instances, fabricated components are machined from solid pieces of metal, thereby facilitating use of nonstandard shapes in constructing the cylindrical body. That is to say, that the cylindrical body can comprise one or more components such that the cylindrical body has one or more section having a uniform inner diameter, one or more sections where such wall is frustoconical with the diameter at the upper end of such sections is greater than the diameter at the lower end of such sections, one or more sections where such wall is frustoconical with the diameter at the lower end of such sections is greater than the diameter at the upper end of such sections, or a combination thereof. In some embodiments, the tangential velocity is sufficient to produce a ratio of the second solids content to the first solids content of less than or equal to 0.05, less than or equal to 0.04, less than or equal to 0.03, less than or equal to 0.02, or less than or equal to 0.01.

Certain Embodiments of Separator Apparatus

The downhole modules 100, 200, 300, 400, 500, and 600, as shown in FIGS. 1-6, are intended to be sized to facilitate use in typical commercial well casing sizes, such as, but not limited to 5.5 inches (14.0 cm) and 7 inches (17.8 cm). In some embodiments, the downhole module has a nominal pipe diameter of 4 inches (10.2 cm) with an actual outside diameter of 4.5 inches (11.4 cm). The housing can be of any length suitable for a specific application and can be extended with additional lengths of pipe in order to increase storage capacity for removed solids. In some embodiments, the bottom or the housing, or alternatively the bottom-most extension added to the housing is closed.

Some embodiments are configured as shown in FIG. 1, the downhole module 100 comprises separator apparatus 110 and housing 180, having central axis 101. Separator apparatus 110 comprises vortex inducer 120 and solids collection conduit 150. Vortex inducer 120 comprises shell element 130 and core element 140.

Vortex inducer 120 comprises a central aperture 121 and one or more helical apertures 122. Each of the one or more helical apertures 122 is characterized by a cross-sectional area A with perimeter P, wherein the cross-sectional area A is perpendicular to a spiral line 123 defined by the centroid of cross-sectional area A at each point along the diameter $D_{122}$ of the one or more helical apertures 122, and hydraulic diameter $D_h$, wherein:

$$D_h = \frac{4A}{P}$$

Spiral line 123 is characterized by a helix lead $L_{122}$ and a helix lead angle θ wherein:

$$\theta = \arctan\left(\frac{L_{122}}{\pi D_{122}}\right)$$

In some embodiments, the ratio of shell element mating surface length $L_{131a}$ and corresponding core element mating surface length $L_{140a}$ to helix lead $L_{122}$ is less than or equal to 1.0, 0.8, 0.6, 0.4, or 0.2.

Vortex inducer 120 comprises shell element 130 and core element 140. Shell element 130 comprises an inner cylindrical surface having one or more helical channels 131, wherein each such channel extends to the upper end of shell element 130. The outer diameter of shell element 530 is less than the inner diameter of the housing 580. Shell element 130 starts with a uniform inner diameter $D_{130}$. The inner surface of the shell element 130 is machined by known methods to produce one or more helical channels having a maximum depth $C_{131}$ such that each helical channel 131 has a diameter $D_{131}$ at the maximum depth of the helical channel 131. After machining the one or more helical channels 131 into the inner surface of shell element 130, one or more strips of the original inner surface having a width $W_{131}$, a diameter $D_{130}$ and length $L_{131a}$ remaining as a first mating surface. Optionally, shell element 130 extends a distance below the lower end of the mating surface for a distance $L_{131b}$, wherein such extension has an inner diameter of $D_{131}$.

Core element 140 comprises a cylindrical inner surface having a diameter $D_{140a}$, which circumscribes the central aperture 121, a cylindrical outer surface having a diameter $D_{140b}$. Length $L_{140a}$ is the mating surface of core element 140, such that the corresponding mating surfaces of the shell element 130 and the core element 140 define the span of the helical apertures 122 when shell element 130 and core element 140 are slidably engaged. Optionally, core element 140 extends for a distance $L_{140b}$ below the lower end of the mating surface when core element 140 and shell element 130 are slidably engaged in the intended operating position.

In some embodiments, $D_{140b}$ is equal or substantially equal to $D_{130}$, where core element 140 and shell element 130 are held in the intended operating position after being slidably engaged by an interference fit between core element 140 and shell element 130. In some embodiments, $D_{130}$ is less than or equal to 5 mil (127 μm), 4 mil (102 μm), 3 mil (76 μm), 2 mil (51 μm), or 1 mil (25 μm) greater than $D_{140b}$, where core element 140 and shell element 130 are held in the intended operating position after being slidably engaged by means other than an interference fit, such as, but not limited to one or more set screws or one or more keys. In some embodiments, the core element and shell element are held together by a taper fit, such as, but not limited to, self-holding tapers such as Morse tapers and Jacobs tapers.

The vortex inducer 120 is formed by slidably engaging the shell element 130 and the core element 140 such that at least a portion of or all of the mating surface and at least a portion of or all of the cylindrical outer surface of the core element 140 are overlapping. The one or more helical apertures 122 are formed by the inner surface of the one or more helical channels 131 and the outer surface of the core element 140.

Solids collection conduit 150 is attached to the lower end of the vortex inducer 120 to form separation chamber 151. In some embodiments, solids collection conduit 150 comprises: a) a first section having a length $L_{150a}$ and inner diameter $D_{150a}$; b) a second section connected to the lower end of the first section and having a length $L_{150b}$ and an inner diameter tapering from $D_{150a}$ at its upper end to $D_{150b}$ at its lower end; c) a third section connected to the lower end of the second section and having a length $L_{150c}$ and inner diameter $D_{150b}$; and d) a fourth section connected to the lower end of the third section and having a length $L_{150d}$ and an inner diameter tapering from $D_{150b}$ at its upper end to a diameter sufficient to permit attachment of the fourth section to the inner surface of the housing 180, wherein such attachment separates the opening defined at the lower end of separation chamber 151 by the lower edge of the fourth section from the feed chamber 182.

In some embodiments, solids collection conduit 150 comprises: a) a first section having a first length and a first inner diameter; and b) a second section connected to the lower end of the first section and having a second length and an inner diameter tapering from the first inner diameter at its upper end to a diameter sufficient to permit attachment of the second section to the inner surface of the housing at its lower end.

In some embodiments, solids collection conduit 150 comprises a first section having a first length and an inner diameter tapering from the first inner diameter of shell element 130 at its upper end to a diameter sufficient to permit attachment of the first section to the inner surface of the housing at its lower end.

In other embodiments, solids collection conduit 150 comprises a substantially cylindrical vertical wall having one or more sections where such wall is vertical, one or more sections where such wall is frustoconical with the diameter at the upper end of such sections is greater than the diameter at the lower end of such sections, one or more sections where such wall is frustoconical with the diameter at the lower end of such sections is greater than the diameter at the upper end of such sections, or a combination thereof.

In the foregoing embodiments, separation chamber 151, formed by attachment of the upper end of solids collection conduit 150 and the lower end of the vortex inducer 120, is fluidly connected to the one or more helical apertures 122 and the central aperture 121 and to the space below the opening formed by the lower edge of the substantially cylindrical vertical wall comprising the one or more vertical sections and/or one or more frustoconical sections.

The connection 160 between the vortex inducer 120 and the solids collection conduit 150 can be by any suitable method sufficient to secure the vortex inducer 120 and the solids collection conduit 150 during operation of the separator apparatus 110, such as, but not limited to one or more welded connections, one or more threaded connections, or a combination thereof. In some embodiments the connection between the vortex inducer 120 and the solids collection conduit 150 is accomplished by fabrication of a lower portion of the vortex inducer 120 and the upper portion of the solids collection conduit 150 from a common piece of metal. That is to say, that fabrication of the separator apparatus 110, or its constituent functional parts of the vortex inducer 120 and the solids collection conduit 150, can comprise fewer or more individual parts and/or fewer or more connection points of such individual parts than are shown in FIG. 1, as may be convenient for fabrication of the separator apparatus 110. The depiction of the vortex inducer 120 and the solids collection conduit 150 and their connection to form separator apparatus 110 in FIG. 1 are intended to show the functional portions of the separator apparatus 110 and are further intended to include any combination of piping, machined parts, and/or fittings assembled in any suitable manner to perform such functions.

The upper end of the separator apparatus 110, specifically the upper end of the vortex inducer 120, is physically connected to the lower end of the treated fluid discharge conduit 170. Although the inner diameter of the central aperture $D_{140a}$ and the inner diameter of the fluid discharge conduit 170 appear to be equal in FIG. 1, the inner diameter of treated fluid discharge conduit 170 can be either larger are smaller than $D_{140a}$. Such differences in diameter and/or the attachment of the vortex inducer 120 to the treated fluid discharge conduit 170 can be accommodated by any combination of piping, machined parts, welded connections, and/or fittings well known in the art. The upper end of the treated fluid discharge conduit 170 is physically connected to the upper end of the housing 180. The lower end of the separator apparatus 110, specifically the lower end of the solids collection conduit 150, is connected to the housing 180 at a location below the one or more inlet ports 181. Such connection of the separator apparatus 110, the treated fluid discharge conduit 170, and the housing 180 forms a feed chamber 182, which is fluidly connected to the exterior of the housing 180 through inlet ports 181, fluidly connected to the separation chamber 151 through the one or more helical apertures 122, and separated from the central aperture 121 by the treated fluid discharge conduit 170.

When in operation, untreated fluid 102 flows into downhole module 100 through one or more inlet ports 181 and then through one or more helical apertures 122. Upon exiting the one or more helical apertures 122, a vortex is created in chamber 151 wherein solids 103 are concentrated on the inner service of solids collection conduit 150 by centrifugal force while treated fluid 104 having a lower solids content are withdrawn from the separator apparatus through central aperture 121 and treated fluid discharge conduit 170.

Without wishing to be bound by any particular theory, it is believed that the section of solids collection conduit 150 identified by length $L_{150c}$ and $D_{150b}$ provides improved efficiency in removal solids since tangential velocity is maintained at a smaller radius, thereby increasing centripetal acceleration. In further embodiments, discontinuities are added to the inner surface of the sections of solids collection conduit 150 identified by length $L_{150b}$ and length $L_{150c}$, or a combination thereof. Such discontinuities include, but are not limited to, fins, ridges, channels, holes, or other surface discontinuities that serve to reduce tangential velocity of the solids and permit gravity to play a greater role in moving the solids downward and out of the solids collection chamber 150.

Figure 2:
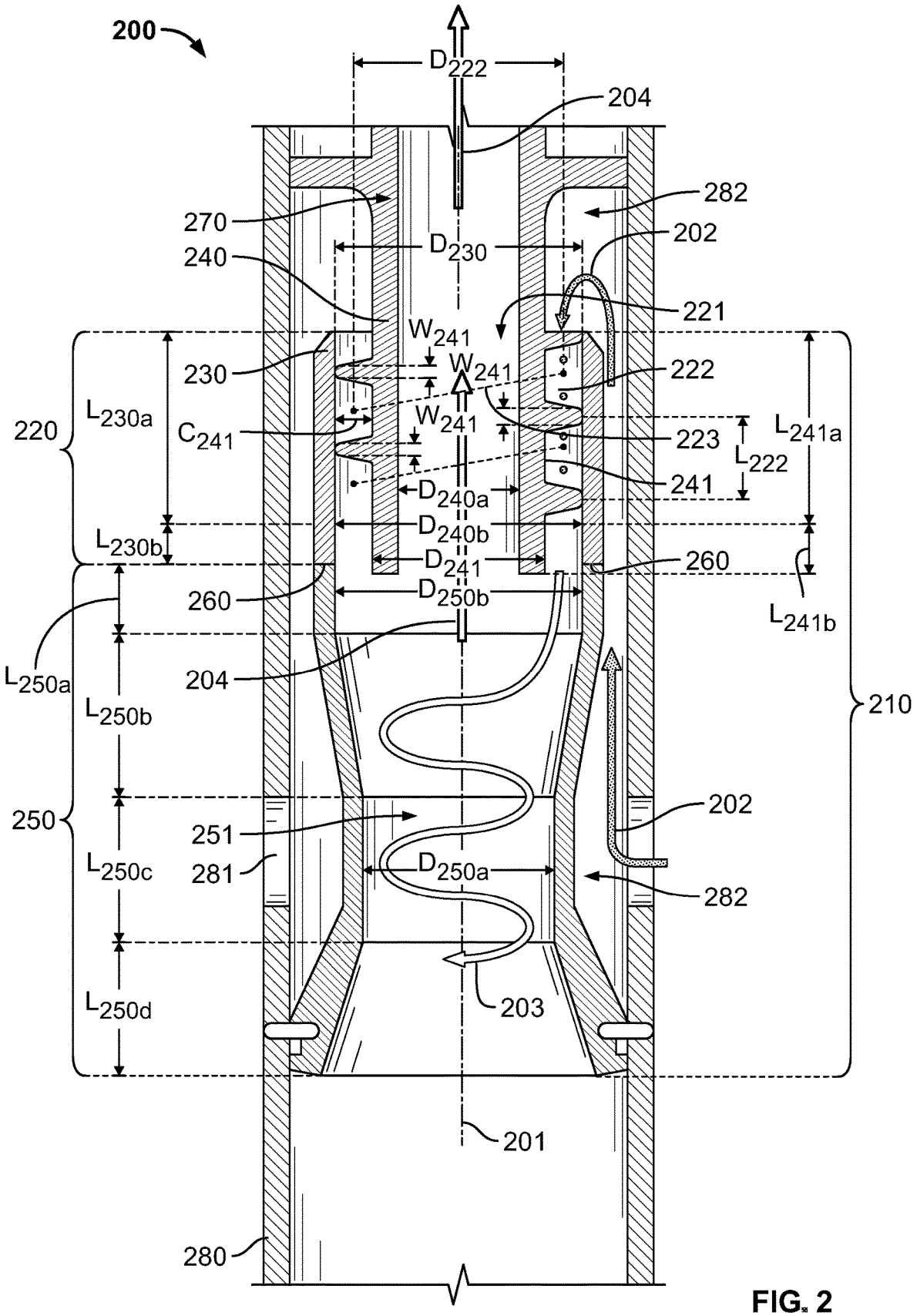
FIG. 2 is a cross-sectional drawing of a second embodiment of a downhole module comprising the separator apparatus described herein.

Some embodiments are configured as shown in FIG. 2, the downhole module 200 comprises separator apparatus 210 and housing 280, having central axis 201. Separator apparatus 210 comprises vortex inducer 220 and solids collection conduit 250. Vortex inducer 220 comprises shell element 230 and core element 240.

Vortex inducer 220 comprises a central aperture 221 and one or more helical apertures 222. Each of the one or more helical apertures 222 is characterized by a cross-sectional area A with perimeter P, wherein the cross-sectional area A is perpendicular to a spiral line 223 defined by the centroid of cross-sectional area A at each point along the diameter $D_{222}$ of the one or more helical apertures 222, and hydraulic diameter $D_h$, wherein:

$$D_h = \frac{4A}{P}$$

Spiral line 223 is characterized by a helix lead $L_{222}$ and a helix lead angle θ wherein:

$$\theta = \arctan\left(\frac{L_{222}}{\pi D_{222}}\right)$$

In some embodiments, the ratio of shell element mating surface length $L_{230a}$ to and corresponding core element mating surface length $L_{241a}$ to helix lead $L_{222}$ is less than or equal to 1.0, 0.8, 0.6, 0.4, or 0.2.

Vortex inducer 220 comprises shell element 230 and core element 240. Core element 240 comprises a cylindrical inner surface having a diameter $D_{240a}$, which circumscribes the central aperture 221, and a cylindrical outer surface having a diameter $D_{240b}$. The outer cylindrical surface of core element 240 comprises one or more helical channels 241, wherein each such channel extends to the upper end of core element 240. Core element 240 starts with a uniform outer diameter $D_{240b}$. The outer surface of the core element 240 is machined by known methods to produce one or more helical channels having a maximum depth $C_{241}$ such that each helical channel 241 has a diameter $D_{241}$ at the maximum depth of the helical channel 241. After machining the one or more helical channels 241 into the inner surface of core element 240, one or more strips of the original inner surface having a width $W_{241}$, a diameter $D_{240b}$ and length $L_{241a}$ remaining as a first mating surface. Optionally, core element 241 extends a distance below the lower end of the mating surface for a distance $L_{241b}$, wherein such extension has an outer diameter of $D_{241}$.

Shell element 230 comprises a cylindrical inner surface having a diameter $D_{230}$. Optionally, shell element 230 extends for a distance $L_{230b}$ below the lower end of the mating surface when core element 240 and shell element 230 are slidably engaged in the intended operating position.

In some embodiments, $D_{240b}$ is equal or substantially equal to $D_{230}$, where core element 240 and shell element 230 are held in the intended operating position after being slidably engaged by an interference fit between core element 240 and shell element 230. In some embodiments, $D_{230}$ is less than or equal to 5 mil (127 μm), 4 mil (102 μm), 3 mil (76 μm), 2 mil (51 μm), or 1 mil (25 μm) greater than $D_{240b}$, where core element 240 and shell element 230 are held in the intended operating position after being slidably engaged by means other than an interference fit, such as, but not limited to one or more set screws or one or more keys. In some embodiments, the core element and shell element are held together by a taper fit, such as, but not limited to, self-holding tapers such as Morse tapers and Jacobs tapers.

The vortex inducer 220 is formed by slidably engaging the shell element 230 and the core element 240 such that at least a portion of or all of the mating surface and at least a portion of or all of the cylindrical inner surface of the shell element 230 are overlapping. The one or more helical apertures 222 are formed by the inner surface of the one or more helical channels 241 and the inner surface of the shell element 230.

Solids collection conduit 250 is attached to the lower end of the vortex inducer 220 to form separation chamber 251. In some embodiments, solids collection conduit 250 comprises: a) a first section having a length $L_{250a}$ and inner diameter $D_{250a}$; b) a second section connected to the lower end of the first section and having a length $L_{250b}$ and an inner diameter tapering from $D_{250a}$ at its upper end to $D_{250b}$ at its lower end; c) a third section connected to the lower end of the second section and having a length $L_{250c}$ and inner diameter $D_{250b}$; and d) a fourth section connected to the lower end of the third section and having a length $L_{250d}$ and an inner diameter tapering from $D_{250b}$ at its upper end to a diameter sufficient to permit attachment of the fourth section to the inner surface of the housing 280, wherein such attachment separates the opening defined at the lower end of separation chamber 251 by the lower edge of the fourth section from the feed chamber 282.

In some embodiments, solids collection conduit 250 comprises: a) a first section having a first length and a first inner diameter; and b) a second section connected to the lower end of the first section and having a second length and an inner diameter tapering from the first inner diameter at its upper end to a diameter sufficient to permit attachment of the second section to the inner surface of the housing at its lower end.

In some embodiments, solids collection conduit 250 comprises a first section having a first length and an inner diameter tapering from the first inner diameter of shell element 230 at its upper end to a diameter sufficient to permit attachment of the first section to the inner surface of the housing at its lower end.

In other embodiments, solids collection conduit 250 comprises a substantially cylindrical vertical wall having one or more sections where such wall is vertical, one or more sections where such wall is frustoconical with the diameter at the upper end of such sections is greater than the diameter at the lower end of such sections, one or more sections where such wall is frustoconical with the diameter at the lower end of such sections is greater than the diameter at the upper end of such sections, or a combination thereof.

In the foregoing embodiments, separation chamber 251, formed by attachment of the upper end of solids collection conduit 250 and the lower end of the vortex inducer 220, is fluidly connected to the one or more helical apertures 222 and the central aperture 221 and to the space below the opening formed by the lower edge of the substantially cylindrical vertical wall comprising the one or more vertical sections and/or one or more frustoconical sections.

The connection 260 between the vortex inducer 220 and the solids collection conduit 250 can be by any suitable method sufficient to secure the vortex inducer 220 and the solids collection conduit 250 during operation of the separator apparatus 210, such as, but not limited to one or more welded connections, one or more threaded connections, or a combination thereof. In some embodiments the connection between the vortex inducer 220 and the solids collection conduit 250 is accomplished by fabrication of a lower portion of the vortex inducer 220 and the upper portion of the solids collection conduit 250 from a common piece of metal. That is to say, that fabrication of the separator apparatus 210, or its constituent functional parts of the vortex inducer 220 and the solids collection conduit 250, can comprise fewer or more individual parts and/or fewer or more connection points of such individual parts than are shown in FIG. 2, as may be convenient for fabrication of the separator apparatus 210. The depiction of the vortex inducer 220 and the solids collection conduit 250 and their connection to form separator apparatus 210 in FIG. 2 are intended to show the functional portions of the separator apparatus 210 and are further intended to include any combination of piping, machined parts, and/or fittings assembled in any suitable manner to perform such functions.

The upper end of the separator apparatus 210, specifically the upper end of the vortex inducer 220, is physically connected to the lower end of the treated fluid discharge conduit 270. Although the inner diameter of the central aperture $D_{240}$, and the inner diameter of the fluid discharge conduit 270 appear to be equal in FIG. 2, the inner diameter of treated fluid discharge conduit 270 can be either larger are smaller than $D_{240a}$. Such differences in diameter and/or the attachment of the vortex inducer 220 to the treated fluid discharge conduit 270 can be accommodated by any combination of piping, machined parts, welded connections, and/or fittings well known in the art. The upper end of the treated fluid discharge conduit 270 is physically connected to the upper end of the housing 280. The lower end of the separator apparatus 210, specifically the lower end of the solids collection conduit 250, is connected to the housing 280 at a location below the one or more inlet ports 281. Such connection of the separator apparatus 210, the treated fluid discharge conduit 270, and the housing 280 forms a feed chamber 282, which is fluidly connected to the exterior of the housing 280 through inlet ports 281, fluidly connected to the separation chamber 251 through the one or more helical apertures 222, and separated from the central aperture 221 by the treated fluid discharge conduit 270.

When in operation, untreated fluid 202 flows into downhole module 200 through one or more inlet ports 281 and then through one or more helical apertures 222. Upon exiting the one or more helical apertures 222, a vortex is created in chamber 251 wherein solids 203 are concentrated on the inner service of solids collection conduit 250 by centrifugal force while treated fluid 204 having a lower solids content are withdrawn from the separator apparatus through central aperture 221 and treated fluid discharge conduit 270.

Without wishing to be bound by any particular theory, it is believed that the section of solids collection conduit 250 identified by length $L_{250c}$ and $D_{250b}$ provides improved efficiency in removal solids since tangential velocity is maintained at a smaller radius, thereby increasing centripetal acceleration. Another advantage of this configuration is that channels 241 on the outer surface of core element 240 provide more improved access to surfaces to be machined. In further embodiments, discontinuities are added to the inner surface of the sections of solids collection conduit 250 identified by length $L_{250b}$ and length $L_{250c}$, or a combination thereof. Such discontinuities include, but are not limited to, fins, ridges, channels, holes, or other surface discontinuities that serve to reduce tangential velocity of the solids and permit gravity to play a greater role in moving the solids downward and out of the solids collection chamber 250.

Figure 3:
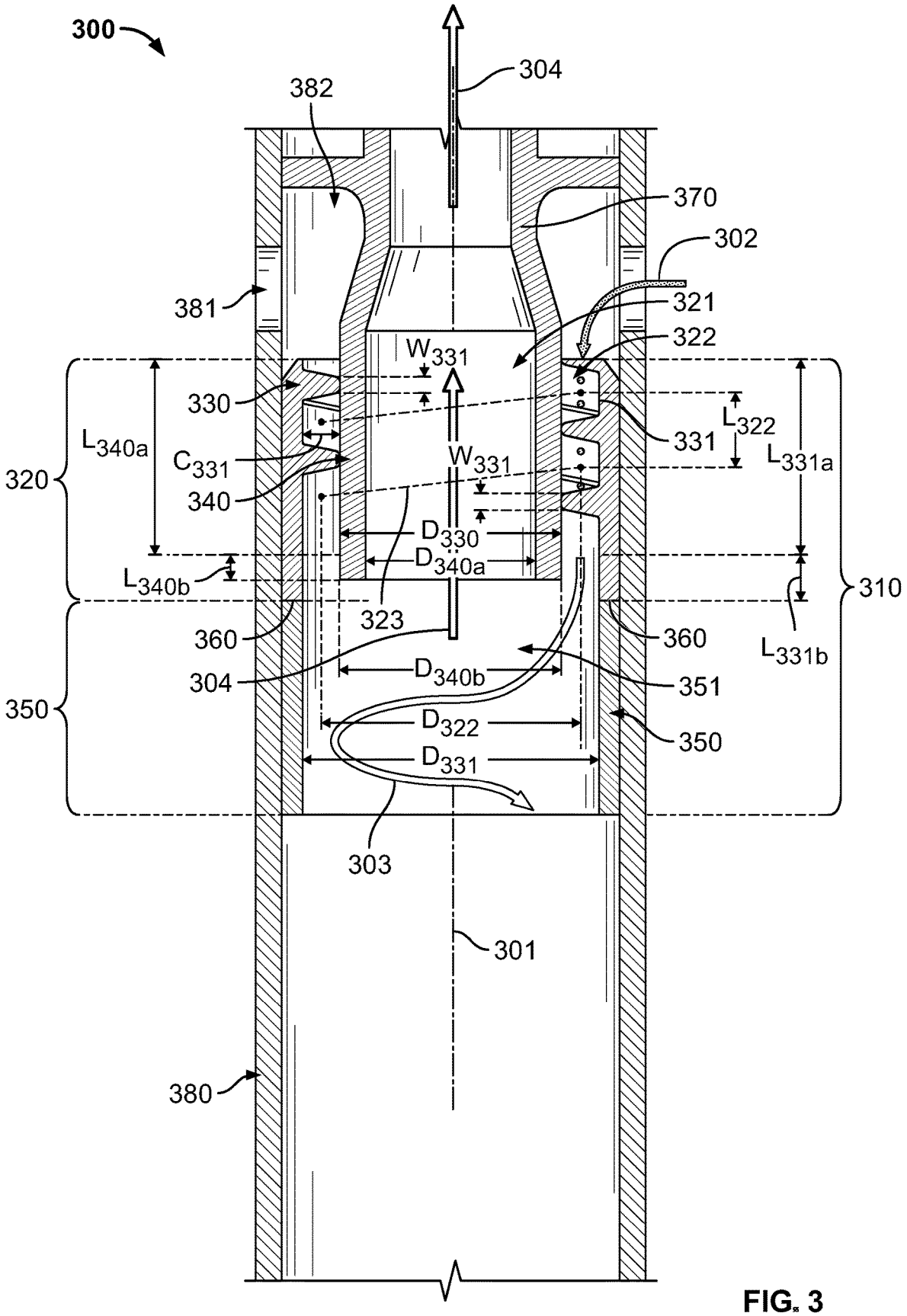
FIG. 3 is a cross-sectional drawing of a third embodiment of a downhole module comprising the separator apparatus described herein.

Some embodiments are configured as shown in FIG. 3, the downhole module 300 comprises separator apparatus 310 and housing 380, having central axis 301. Separator apparatus 310 comprises vortex inducer 320 and solids collection conduit 350. Vortex inducer 320 comprises shell element 330 and core element 340.

Vortex inducer 320 comprises a central aperture 321 and one or more helical apertures 322. Each of the one or more helical apertures 322 is characterized by a cross-sectional area A with perimeter P, wherein the cross-sectional area A is perpendicular to a spiral line 323 defined by the centroid of cross-sectional area A at each point along the diameter $D_{322}$ of the one or more helical apertures 322, and hydraulic diameter $D_h$, wherein:

$$D_h = \frac{4A}{P}$$

Spiral line 323 is characterized by a helix lead $L_{322}$ and a helix lead angle θ wherein:

$$\theta = \arctan\left(\frac{L_{322}}{\pi D_{322}}\right)$$

In some embodiments, the ratio of shell element mating surface length $L_{331a}$ and corresponding core element mating surface length $L_{340a}$ to helix lead $L_{322}$ is less than or equal to 1.0, 0.8, 0.6, 0.4, or 0.2.

Vortex inducer 320 comprises shell element 330 and core element 340. Shell element 330 comprises an inner cylindrical surface having one or more helical channels 331, each such channel extends to the upper end of shell element 330. The outer diameter of shell element 330 is less than or equal to the inner diameter of the housing 380. Shell element 330 starts with a uniform inner diameter $D_{331}$. The inner surface of the shell element is machined by known methods to produce one or more helical channels having a maximum depth $C_{331}$ such that each helical channel 331 has a diameter $D_{331}$ at the maximum depth of the helical channel 331. After machining the one or more helical channels 331 into the inner surface of shell element 330, one or more strips of the original inner surface having a width $W_{331}$, a diameter $D_{331}$ and length $L_{331a}$ remaining as a first mating surface. Optionally, shell element 330 extends a distance below the lower end of the mating surface for a distance $L_{331b}$, wherein such extension has an inner diameter of $D_{331}$.

Core element 340 comprises a cylindrical inner surface having a diameter $D_{340a}$, which circumscribes the central aperture 321, and a cylindrical outer surface having a diameter $D_{340b}$. Length $L_{340a}$ is the mating surface of core element 340, such that the corresponding mating surfaces of the shell element 330 and the core element 340 define the span of the helical apertures 322 when shell element 330 and core element 340 are slidably engaged. Optionally, core element 340 extends for a distance $L_{340b}$ below the lower end of the mating surface when core element 340 and shell element 330 are slidably engaged in the intended operating position.

In some embodiments, $D_{340b}$ is equal or substantially equal to $D_{330}$, where core element 340 and shell element 330 are held in the intended operating position after being slidably engaged by an interference fit between core element 340 and shell element 330. In some embodiments, $D_{331}$ is less than or equal to 5 mil (127 μm), 4 mil (102 μm), 3 mil (76 μm), 2 mil (51 μm), or 1 mil (25 μm) greater than $D_{340b}$, where core element 340 and shell element 330 are held in the intended operating position after being slidably engaged by means other than an interference fit, such as, but not limited to one or more set screws or one or more keys. In some embodiments, the core element and shell element are held together by a taper fit, such as, but not limited to, self-holding tapers such as Morse tapers and Jacobs tapers.

The vortex inducer 320 is formed by slidably engaging the shell element 330 and the core element 340 such that at least a portion of or all of the mating surface and at least a portion of or all of the cylindrical outer surface of the core element 340 are overlapping. The one or more helical apertures 322 are formed by the inner surface of the one or more helical channels 331 and the outer surface of the core element 340.

Solids collection conduit 350 is attached to the lower end of the vortex inducer 320 to form separation chamber 351. In some embodiments, solids collection conduit 350 comprises a substantially cylindrical vertical wall having one or more sections where such wall is vertical, one or more sections where such wall is frustoconical with the diameter at the upper end of such sections is greater than the diameter at the lower end of such sections, one or more sections where such wall is frustoconical with the diameter at the lower end of such sections is greater than the diameter at the upper end of such sections, or a combination thereof.

In the foregoing embodiments, separation chamber 351, formed by attachment of the upper end of solids collection conduit 350 and the lower end of the vortex inducer 320, is fluidly connected to the one or more helical apertures 322 and the central aperture 321 and to the space below the opening formed by the lower edge of the substantially cylindrical vertical wall comprising the one or more vertical sections and/or one or more frustoconical sections.

The connection 360 between the vortex inducer 320 and the solids collection conduit 350 can be by any suitable method sufficient to secure the vortex inducer 320 and the solids collection conduit 350 during operation of the separator apparatus 310, such as, but not limited to one or more welded connections, one or more threaded connections, or a combination thereof. In some embodiments the connection between the vortex inducer 320 and the solids collection conduit 350 is accomplished by fabrication of a lower portion of the vortex inducer 320 and the upper portion of the solids collection conduit 350 from a common piece of metal. That is to say, that fabrication of the separator apparatus 310, or its constituent functional parts of the vortex inducer 320 and the solids collection conduit 350, can comprise fewer or more individual parts and/or fewer or more connection points of such individual parts than are shown in FIG. 3, as may be convenient for fabrication of the separator apparatus 310. The depiction of the vortex inducer 320 and the solids collection conduit 350 and their connection to form separator apparatus 310 in FIG. 3 are intended to show the functional portions of the separator apparatus 310 and are further intended to include any combination of piping, machined parts, and/or fittings assembled in any suitable manner to perform such functions.

The upper end of the separator apparatus 310, specifically the upper end of the vortex inducer 320, is physically connected to the lower end of the treated fluid discharge conduit 370. Although the inner diameter of the central aperture $D_{340a}$ and the inner diameter of the fluid discharge conduit 370 appear to be equal in FIG. 3, the inner diameter of treated fluid discharge conduit 370 can be either larger are smaller than $D_{340a}$. Such differences in diameter and/or the attachment of the vortex inducer 320 to the treated fluid discharge conduit 370 can be accommodated by any combination of piping, machined parts, welded connections, and/or fittings well known in the art. The upper end of the treated fluid discharge conduit 370 is physically connected to the upper end of the housing 380. The lower end of the separator apparatus 310, specifically the lower end of the solids collection conduit 350, is connected to the housing 380 at a location below the one or more inlet ports 381. Such connection of the separator apparatus 310, the treated fluid discharge conduit 370, and the housing 380 forms a feed chamber 382, which is fluidly connected to the exterior of the housing 380 through inlet ports 381, fluidly connected to the separation chamber 351 through the one or more helical apertures 322, and separated from the central aperture 321 by the treated fluid discharge conduit 370.

When in operation, untreated fluid 302 flows into downhole module 300 through one or more inlet ports 381 and then through one or more helical apertures 322. Upon exiting the one or more helical apertures 322, a vortex is created in chamber 351 wherein solids 303 are concentrated on the inner service of solids collection conduit 350 by centrifugal force while treated fluid 304 having a lower solids content are withdrawn from the separator apparatus through central aperture 321 and treated fluid discharge conduit 370.

This embodiment provides a more compact feed chamber 382 having a more direct path from the inlet ports 381 to helical apertures 322, and location of the inlet ports 381 above the separator apparatus 310 permit a larger diameter $D_{331}$ of helical aperture. Without wishing to be bound by any particular theory, it is believed that both of these factors contribute to higher flow velocity in the one or more helical apertures $D_{322}$, leading in turn to improved solids removal at a given pressure drop across the vortex inducer 320. Additionally, this embodiment permits a larger diameter central aperture 321 which results in a lower localized velocity of treated fluid flow 304 at the upper end of separation chamber 351, thereby reducing the tendency to entrain any solids in treated fluid flow 304 at a given design flow rate through separator apparatus 310. In further embodiments, discontinuities are added to the inner surface of the sections of solids collection conduit 350. Such discontinuities include, but are not limited to, fins, ridges, channels, holes, or other surface discontinuities that serve to reduce tangential velocity of the solids and permit gravity to play a greater role in moving the solids downward and out of the solids collection chamber 350.

Figure 4:
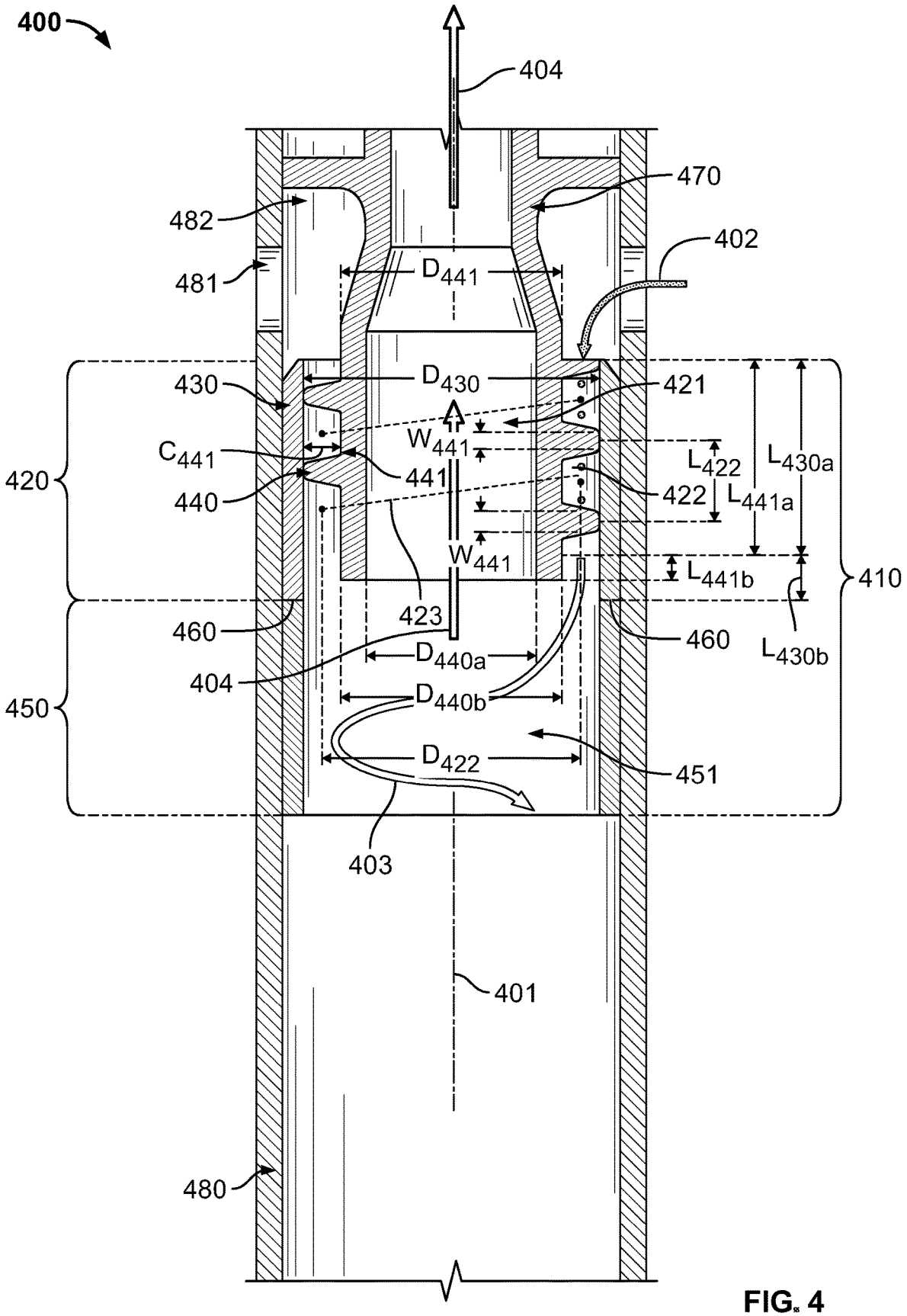
FIG. 4 is a cross-sectional drawing of a fourth embodiment of a downhole module comprising the separator apparatus described herein.

Some embodiments are configured as shown in FIG. 4, the downhole module 400 comprises separator apparatus 410 and housing 480, having central axis 401. Separator apparatus 410 comprises vortex inducer 420 and solids collection conduit 450. Vortex inducer 420 comprises shell element 430 and core element 440.

Vortex inducer 420 comprises a central aperture 421 and one or more helical apertures 422. Each of the one or more helical apertures 422 is characterized by a cross-sectional area A with perimeter P, wherein the cross-sectional area A is perpendicular to a spiral line 423 defined by the centroid of cross-sectional area A at each point along the diameter $D_{422}$ of the one or more helical apertures 422, and hydraulic diameter $D_h$, wherein:

$$D_h = \frac{4A}{P}$$

Spiral line 423 is characterized by a helix lead $L_{422}$ and a helix lead angle θ wherein:

$$\theta = \arctan\left(\frac{L_{422}}{\pi D_{422}}\right)$$

In some embodiments, the ratio of shell element mating surface length $L_{430a}$ to and corresponding core element mating surface length $L_{441a}$ to helix lead $L_{422}$ is less than or equal to 1.0, 0.8, 0.6, 0.4, or 0.2.

Vortex inducer 420 comprises shell element 430 and core element 440. Core element 440 comprises a cylindrical inner surface having a diameter $D_{440a}$, which circumscribes the central aperture 421 and a cylindrical outer surface having a diameter $D_{440b}$. The outer cylindrical surface of core element 440 comprises one or more helical channels 441, wherein each such channel extends to the upper end of core element 440. Shell element 440 starts with a uniform outer diameter $D_{440b}$. The outer surface of the core element 440 is machined by known methods to produce one or more helical channels having a maximum depth $C_{441}$ such that each helical channel 441 has a diameter $D_{441}$ at the maximum depth of the helical channel 441. After machining the one or more helical channels 441 into the inner surface of core element 440, one or more strips of the original inner surface having a width $W_{441}$, a diameter $D_{440b}$ and length $L_{441a}$ remaining as a first mating surface. Optionally, core element 441 extends a distance below the lower end of the mating surface for a distance $L_{441b}$, wherein such extension has an outer diameter of $D_{441}$.

Shell element 430 comprises a cylindrical inner surface having a diameter $D_{430}$. Optionally, shell element 430 extends for a distance $L_{430b}$ below the lower end of the mating surface when core element 440 and shell element 430 are slidably engaged in the intended operating position.

In some embodiments, $D_{440b}$ is equal or substantially equal to $D_{430}$, where core element 440 and shell element 430 are held in the intended operating position after being slidably engaged by an interference fit between core element 440 and shell element 430. In some embodiments, $D_{430}$ is less than or equal to 5 mil (127 μm), 4 mil (102 μm), 3 mil (76 μm), 2 mil (51 μm), or 1 mil (25 μm) greater than $D_{440b}$, where core element 440 and shell element 430 are held in the intended operating position after being slidably engaged by means other than an interference fit, such as, but not limited to one or more set screws or one or more keys. In some embodiments, the core element and shell element are held together by a taper fit, such as, but not limited to, self-holding tapers such as Morse tapers and Jacobs tapers.

The vortex inducer 420 is formed by slidably engaging the shell element 430 and the core element 440 such that at least a portion of or all of the mating surface and at least a portion of or all of the cylindrical inner surface of the shell element 430 are overlapping. The one or more helical apertures 422 are formed by the inner surface of the one or more helical channels 441 and the inner surface of the shell element 430.

Solids collection conduit 450 is attached to the lower end of the vortex inducer 420 to form separation chamber 451. In some embodiments, solids collection conduit 450 comprises a substantially cylindrical vertical wall having one or more sections where such wall is vertical, one or more sections where such wall is frustoconical with the diameter at the upper end of such sections is greater than the diameter at the lower end of such sections, one or more sections where such wall is frustoconical with the diameter at the lower end of such sections is greater than the diameter at the upper end of such sections, or a combination thereof.

In the foregoing embodiments, separation chamber 451, formed by attachment of the upper end of solids collection conduit 450 and the lower end of the vortex inducer 420, is fluidly connected to the one or more helical apertures 422 and the central aperture 421 and to the space below the opening formed by the lower edge of the substantially cylindrical vertical wall comprising the one or more vertical sections and/or one or more frustoconical sections.

The connection 460 between the vortex inducer 420 and the solids collection conduit 450 can be by any suitable method sufficient to secure the vortex inducer 420 and the solids collection conduit 450 during operation of the separator apparatus 410, such as, but not limited to one or more welded connections, one or more threaded connections, or a combination thereof. In some embodiments the connection between the vortex inducer 420 and the solids collection conduit 450 is accomplished by fabrication of a lower portion of the vortex inducer 420 and the upper portion of the solids collection conduit 450 from a common piece of metal. That is to say, that fabrication of the separator apparatus 410, or its constituent functional parts of the vortex inducer 420 and the solids collection conduit 450, can comprise fewer or more individual parts and/or fewer or more connection points of such individual parts than are shown in FIG. 4, as may be convenient for fabrication of the separator apparatus 410. The depiction of the vortex inducer 420 and the solids collection conduit 450 and their connection to form separator apparatus 410 in FIG. 4 are intended to show the functional portions of the separator apparatus 410 and are further intended to include any combination of piping, machined parts, and/or fittings assembled in any suitable manner to perform such functions.

The upper end of the separator apparatus 410, specifically the upper end of the vortex inducer 420, is physically connected to the lower end of the treated fluid discharge conduit 470. Although the inner diameter of the central aperture $D_{440a}$ and the inner diameter of the fluid discharge conduit 470 appear to be equal in FIG. 4, the inner diameter of treated fluid discharge conduit 470 can be either larger are smaller than $D_{440a}$. Such differences in diameter and/or the attachment of the vortex inducer 420 to the treated fluid discharge conduit 470 can be accommodated by any combination of piping, machined parts, welded connections, and/or fittings well known in the art. The upper end of the treated fluid discharge conduit 470 is physically connected to the upper end of the housing 480. The lower end of the separator apparatus 410, specifically the lower end of the solids collection conduit 450, is connected to the housing 480 at a location below the one or more inlet ports 481. Such connection of the separator apparatus 410, the treated fluid discharge conduit 470, and the housing 480 forms a feed chamber 482, which is fluidly connected to the exterior of the housing 480 through inlet ports 481, fluidly connected to the separation chamber 451 through the one or more helical apertures 422, and separated from the central aperture 421 by the treated fluid discharge conduit 470.

When in operation, untreated fluid 402 flows into downhole module 400 through one or more inlet ports 481 and then through one or more helical apertures 422. Upon exiting the one or more helical apertures 422, a vortex is created in chamber 451 wherein solids 403 are concentrated on the inner service of solids collection conduit 450 by centrifugal force while treated fluid 404 having a lower solids content are withdrawn from the separator apparatus through central aperture 421 and treated fluid discharge conduit 470.

This embodiment provides a more compact feed chamber 482 having a more direct path from the inlet ports 481 to helical apertures 422, and location of the inlet ports 481 above the separator apparatus 410 permit a larger diameter $D_{431}$ of helical aperture. Without wishing to be bound by any particular theory, it is believed that both of these factors contribute to higher flow velocity in the one or more helical apertures $D_{422}$, leading in turn to improved solids removal at a given pressure drop across the vortex inducer 420. Additionally, this embodiment permits a larger diameter central aperture 421 which results in a lower localized velocity of treated fluid flow 404 at the upper end of separation chamber 451, thereby reducing the tendency to entrain any solids in treated fluid flow 404 at a given design flow rate through separator apparatus 410. Another advantage of this configuration is that channels 441 on the outer surface of core element 440 provide more improved access to surfaces to be machined. In further embodiments, discontinuities are added to the inner surface of the sections of solids collection conduit 450. Such discontinuities include, but are not limited to, fins, ridges, channels, holes, or other surface discontinuities that serve to reduce tangential velocity of the solids and permit gravity to play a greater role in moving the solids downward and out of the solids collection chamber 450.

Figure 5:
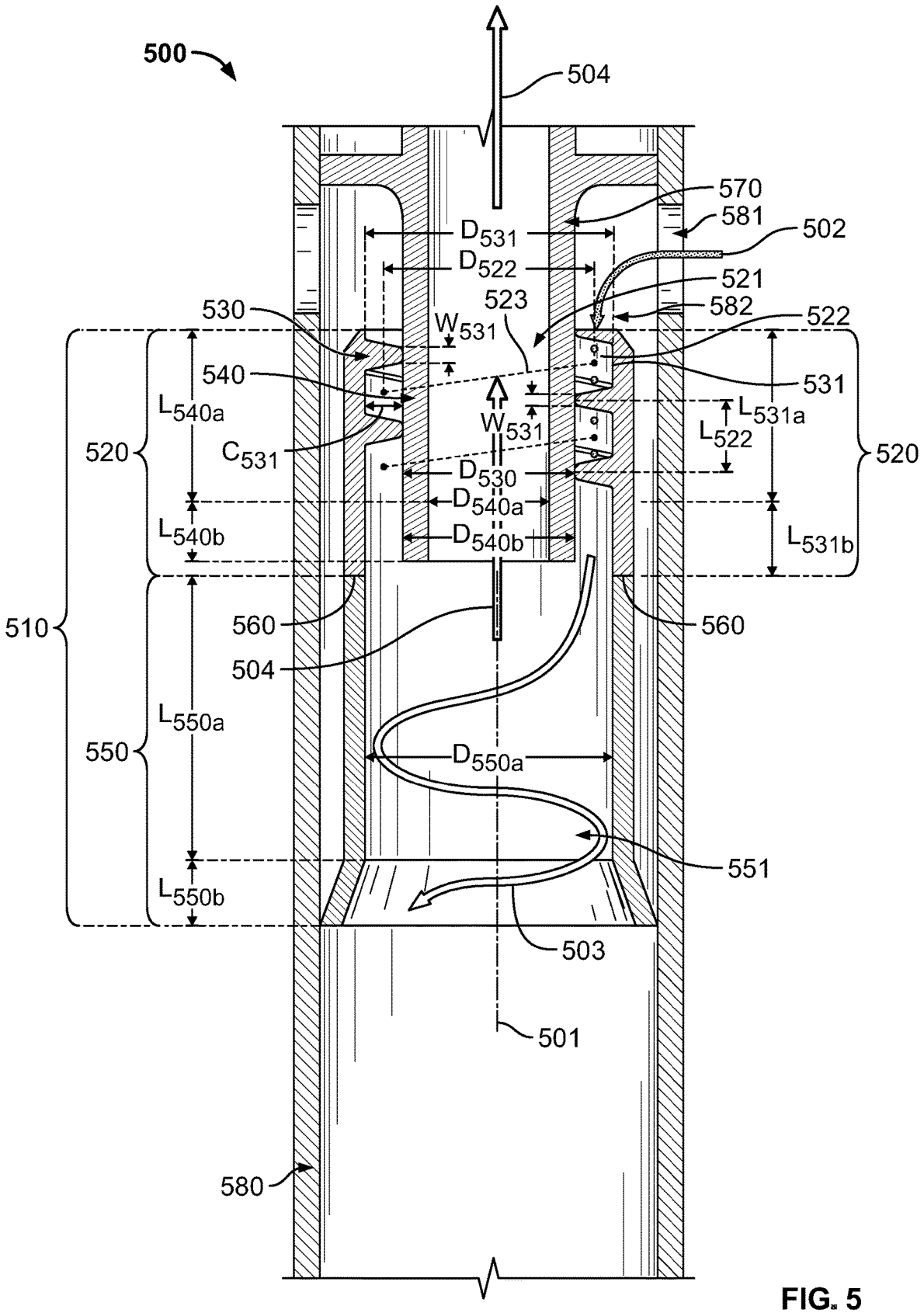
FIG. 5 is a cross-sectional drawing of a fifth embodiment of a downhole module comprising the separator apparatus described herein.

Some embodiments are configured as shown in FIG. 5, the downhole module 500 comprises separator apparatus 510 and housing 580, having central axis 501. Separator apparatus 510 comprises vortex inducer 520 and solids collection conduit 550. Vortex inducer 520 comprises shell element 530 and core element 540.

Vortex inducer 520 comprises a central aperture 521 and one or more helical apertures 522. Each of the one or more helical apertures 522 is characterized by a cross-sectional area A with perimeter P, wherein the cross-sectional area A is perpendicular to a spiral line 523 defined by the centroid of cross-sectional area A at each point along the diameter $D_{522}$ of the one or more helical apertures 522, and hydraulic diameter $D_h$, wherein:

$$D_h = \frac{4A}{P}$$

Spiral line 523 is characterized by a helix lead $L_{522}$ and a helix lead angle θ wherein:

$$\theta = \arctan\left(\frac{L_{522}}{\pi D_{522}}\right)$$

In some embodiments, the ratio of shell element mating surface length $L_{531a}$ and corresponding core element mating surface length $L_{540a}$ to helix lead $L_{522}$ is less than or equal to 1.0, 0.8, 0.6, 0.4, or 0.2.

Vortex inducer 520 comprises shell element 530 and core element 540. Shell element 530 comprises an inner cylindrical surface having one or more helical channels 531, each such channel extends to the upper end of shell element 530. The outer diameter of shell element 530 is less than or equal to the inner diameter of the housing 580. Shell element 530 starts with a uniform inner diameter $D_{531a}$. The inner surface of the shell element is machined by known methods to produce one or more helical channels having a maximum depth $C_{531}$ such that each helical channel 531 has a diameter $D_{531}$ at the maximum depth of the helical channel 531. After machining the one or more helical channels 531 into the inner surface of shell element 530, one or more strips of the original inner surface having a width $W_{531}$, a diameter $D_{531a}$ and length $L_{531a}$ remaining as a first mating surface. Optionally, shell element 530 extends a distance below the lower end of the mating surface for a distance $L_{531b}$, wherein such extension has an inner diameter of $D_{531}$.

Core element 540 comprises a cylindrical inner surface having a diameter $D_{540a}$, which circumscribes the central aperture 521 and a cylindrical outer surface having a diameter $D_{540b}$. Length $L_{540a}$ is the mating surface of core element 540, such that the corresponding mating surfaces of the shell element 530 and the core element 540 define the span of the helical apertures 522 when shell element 530 and core element 540 are slidably engaged. Optionally, core element 540 extends for a distance $L_{540b}$ below the lower end of the mating surface when core element 540 and shell element 530 are slidably engaged in the intended operating position.

In some embodiments, $D_{540b}$ is equal or substantially equal to $D_{531a}$, where core element 540 and shell element 530 are held in the intended operating position after being slidably engaged by an interference fit between core element 540 and shell element 530. In some embodiments, $D_{540b}$ is less than or equal to 5 mil (127 μm), 4 mil (102 μm), 3 mil (76 μm), 2 mil (51 μm), or 1 mil (25 μm) greater than $D_{531a}$, where core element 540 and shell element 530 are held in the intended operating position after being slidably engaged by means other than an interference fit, such as, but not limited to one or more set screws or one or more keys. In some embodiments, the core element and shell element are held together by a taper fit, such as, but not limited to, self-holding tapers such as Morse tapers and Jacobs tapers.

The vortex inducer 520 is formed by slidably engaging the shell element 530 and the core element 540 such that at least a portion of or all of the mating surface and at least a portion of or all of the cylindrical outer surface of the core element 540 are overlapping. The one or more helical apertures 522 are formed by the inner surface of the one or more helical channels 531 and the outer surface of the core element 540.

Solids collection conduit 550 is attached to the lower end of the vortex inducer 520 to form separation chamber 551. In some embodiments, solids collection conduit 550 comprises: a) a first section having a length $L_{550a}$ and inner diameter $D_{550a}$; b) a second section connected to the lower end of the first section and having a length $L_{550b}$ and an inner diameter tapering from $D_{550a}$ at its upper end to a diameter sufficient to permit attachment of the second section to the inner surface of the housing 580, wherein such attachment separates the opening defined at the lower end of separation chamber 551 by the lower edge of the second section from the feed chamber 582.

In the foregoing embodiments, separation chamber 551, formed by attachment of the upper end of solids collection conduit 550 and the lower end of the vortex inducer 520, is fluidly connected to the one or more helical apertures 522 and the central aperture 521 and to the space below the opening formed by the lower edge of the substantially cylindrical vertical wall comprising the one or more vertical sections and/or one or more frustoconical sections.

The connection 560 between the vortex inducer 520 and the solids collection conduit 550 can be by any suitable method sufficient to secure the vortex inducer 520 and the solids collection conduit 550 during operation of the separator apparatus 510, such as, but not limited to one or more welded connections, one or more threaded connections, or a combination thereof. In some embodiments the connection between the vortex inducer 520 and the solids collection conduit 550 is accomplished by fabrication of a lower portion of the vortex inducer 520 and the upper portion of the solids collection conduit 550 from a common piece of metal. That is to say, that fabrication of the separator apparatus 510, or its constituent functional parts of the vortex inducer 520 and the solids collection conduit 550, can comprise fewer or more individual parts and/or fewer or more connection points of such individual parts than are shown in FIG. 5, as may be convenient for fabrication of the separator apparatus 510. The depiction of the vortex inducer 520 and the solids collection conduit 550 and their connection to form separator apparatus 510 in FIG. 5 are intended to show the functional portions of the separator apparatus 510 and are further intended to include any combination of piping, machined parts, and/or fittings assembled in any suitable manner to perform such functions.

The upper end of the separator apparatus 510, specifically the upper end of the vortex inducer 520, is physically connected to the lower end of the treated fluid discharge conduit 570. Although the inner diameter of the central aperture $D_{540a}$ and the inner diameter of the fluid discharge conduit 570 appear to be equal in FIG. 5, the inner diameter of treated fluid discharge conduit 570 can be either larger are smaller than $D_{540a}$. Such differences in diameter and/or the attachment of the vortex inducer 520 to the treated fluid discharge conduit 570 can be accommodated by any combination of piping, machined parts, welded connections, and/or fittings well known in the art. The upper end of the treated fluid discharge conduit 570 is physically connected to the upper end of the housing 580. The lower end of the separator apparatus 510, specifically the lower end of the solids collection conduit 550, is connected to the housing 580 at a location below the one or more inlet ports 581. Such connection of the separator apparatus 510, the treated fluid discharge conduit 570, and the housing 580 forms a feed chamber 582, which is fluidly connected to the exterior of the housing 580 through inlet ports 581, fluidly connected to the separation chamber 551 through the one or more helical apertures 522, and separated from the central aperture 521 by the treated fluid discharge conduit 570.

When in operation, untreated fluid 502 flows into downhole module 500 through one or more inlet ports 581 and then through one or more helical apertures 522. Upon exiting the one or more helical apertures 522, a vortex is created in chamber 551 wherein solids 503 are concentrated on the inner service of solids collection conduit 550 by centrifugal force while treated fluid 504 having a lower solids content are withdrawn from the separator apparatus through central aperture 521 and treated fluid discharge conduit 570.

Without wishing to be bound by any particular theory, it is believed that the section of solids collection conduit 550 identified by length $L_{550b}$ provides improved efficiency in removal solids since tangential velocity since remaining centrifugal force would have downward component in addition to a radial component due to the frustoconical shape of this section of solids collection conduit 550. Such component of downward force would promote discharge of solids from the lower end of solids collection conduit 550. In further embodiments, discontinuities are added to the inner surface of the sections of solids collection conduit 550 identified by length $L_{550a}$ and length $L_{550b}$, or a combination thereof. Such discontinuities include, but are not limited to, fins, ridges, channels, holes, or other surface discontinuities that serve to reduce tangential velocity of the solids and permit gravity to play a greater role in moving the solids downward and out of the solids collection chamber 550.

Figure 6:
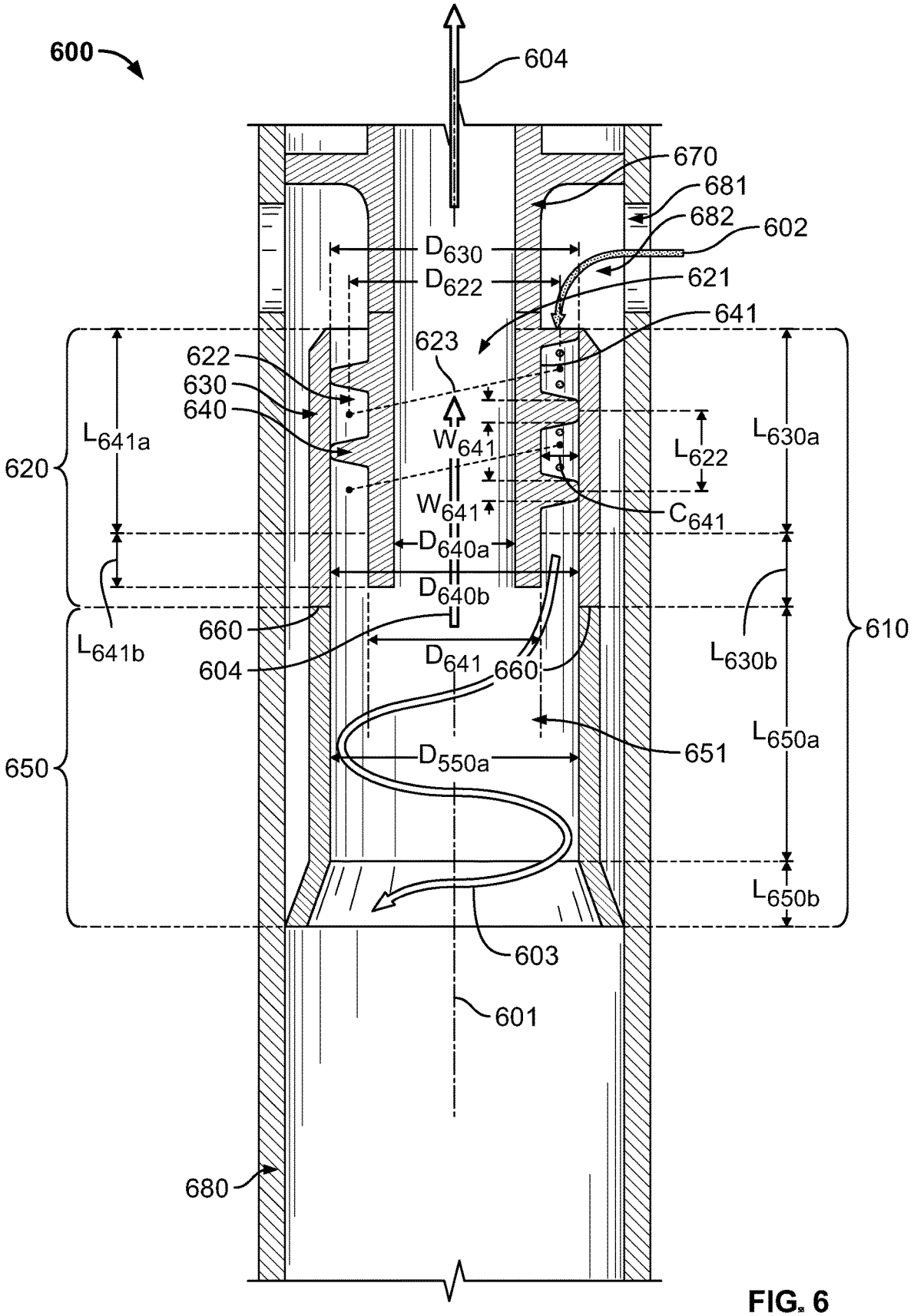
FIG. 6 is a cross-sectional drawing of a sixth embodiment of a downhole module comprising the separator apparatus described herein.

Some embodiments are configured as shown in FIG. 6, the downhole module 600 comprises separator apparatus 610 and housing 680, having central axis 601. Separator apparatus 610 comprises vortex inducer 620 and solids collection conduit 650. Vortex inducer 620 comprises shell element 630 and core element 640.

Vortex inducer 620 comprises a central aperture 621 and one or more helical apertures 622. Each of the one or more helical apertures 622 is characterized by a cross-sectional area A with perimeter P, wherein the cross-sectional area A is perpendicular to a spiral line 623 defined by the centroid of cross-sectional area A at each point along the diameter $D_{622}$ of the one or more helical apertures 622, and hydraulic diameter $D_h$, wherein:

$$D_h = \frac{4A}{P}$$

Spiral line 623 is characterized by a helix lead $L_{622}$ and a helix lead angle θ wherein:

$$\theta = \arctan\left(\frac{L_{622}}{\pi D_{622}}\right)$$

In some embodiments, the ratio of shell element mating surface length $L_{630a}$ to and corresponding core element mating surface length $L_{641a}$ to helix lead $L_{622}$ is less than or equal to 1.0, 0.8, 0.6, 0.4, or 0.2.

Vortex inducer 620 comprises shell element 630 and core element 640. Core element 640 comprises a cylindrical inner surface having a diameter $D_{640a}$, which circumscribes the central aperture 621 and a cylindrical outer surface having a diameter $D_{640b}$. The outer cylindrical surface of core element 640 comprises one or more helical channels 641, wherein each such channel extends to the upper end of core element 640. Shell element 640 starts with a uniform outer diameter $D_{640b}$. The outer surface of the core element 640 is machined by known methods to produce one or more helical channels having a maximum depth $C_{641}$ such that each helical channel 641 has a diameter $D_{641}$ at the maximum depth of the helical channel 641. After machining the one or more helical channels 641 into the inner surface of core element 640, one or more strips of the original inner surface having a width $W_{641}$, a diameter $D_{640b}$ and length $L_{641a}$ remaining as a first mating surface. Optionally, core element 641 extends a distance below the lower end of the mating surface for a distance $L_{641b}$, wherein such extension has an outer diameter of $D_{641}$.

Shell element 630 comprises a cylindrical inner surface having a diameter $D_{630}$. Optionally, shell element 630 extends for a distance $L_{630b}$ below the lower end of the mating surface when core element 640 and shell element 630 are slidably engaged in the intended operating position.

In some embodiments, $D_{640b}$ is equal or substantially equal to $D_{630}$, where core element 640 and shell element 630 are held in the intended operating position after being slidably engaged by an interference fit between core element 640 and shell element 630. In some embodiments, $D_{630}$ is less than or equal to 5 mil (127 μm), 4 mil (102 μm), 3 mil (76 μm), 2 mil (51 μm), or 1 mil (25 μm) greater than $D_{640b}$, where core element 640 and shell element 630 are held in the intended operating position after being slidably engaged by means other than an interference fit, such as, but not limited to one or more set screws or one or more keys. In some embodiments, the core element and shell element are held together by a taper fit, such as, but not limited to, self-holding tapers such as Morse tapers and Jacobs tapers.

The vortex inducer 620 is formed by slidably engaging the shell element 630 and the core element 640 such that at least a portion of or all of the mating surface and at least a portion of or all of the cylindrical inner surface of the shell element 630 are overlapping. The one or more helical apertures 622 are formed by the inner surface of the one or more helical channels 641 and the inner surface of the shell element 630.

Solids collection conduit 650 is attached to the lower end of the vortex inducer 620 to form separation chamber 651. In some embodiments, solids collection conduit 650 comprises: a) a first section having a length $L_{650a}$ and inner diameter $D_{650a}$; b) a second section connected to the lower end of the first section and having a length $L_{650b}$ and an inner diameter tapering from $D_{650a}$ at its upper end to a diameter sufficient to permit attachment of the second section to the inner surface of the housing 680, wherein such attachment separates the opening defined at the lower end of separation chamber 651 by the lower edge of the second section from the feed chamber 682.

In the foregoing embodiments, separation chamber 651, formed by attachment of the upper end of solids collection conduit 650 and the lower end of the vortex inducer 620, is fluidly connected to the one or more helical apertures 622 and the central aperture 621 and to the space below the opening formed by the lower edge of the substantially cylindrical vertical wall comprising the one or more vertical sections and/or one or more frustoconical sections.

The connection 660 between the vortex inducer 620 and the solids collection conduit 650 can be by any suitable method sufficient to secure the vortex inducer 620 and the solids collection conduit 650 during operation of the separator apparatus 610, such as, but not limited to one or more welded connections, one or more threaded connections, or a combination thereof. In some embodiments the connection between the vortex inducer 620 and the solids collection conduit 650 is accomplished by fabrication of a lower portion of the vortex inducer 620 and the upper portion of the solids collection conduit 650 from a common piece of metal. That is to say, that fabrication of the separator apparatus 610, or its constituent functional parts of the vortex inducer 620 and the solids collection conduit 650, can comprise fewer or more individual parts and/or fewer or more connection points of such individual parts than are shown in FIG. 6, as may be convenient for fabrication of the separator apparatus 610. The depiction of the vortex inducer 620 and the solids collection conduit 650 and their connection to form separator apparatus 610 in FIG. 6 are intended to show the functional portions of the separator apparatus 610 and are further intended to include any combination of piping, machined parts, and/or fittings assembled in any suitable manner to perform such functions.

The upper end of the separator apparatus 610, specifically the upper end of the vortex inducer 620, is physically connected to the lower end of the treated fluid discharge conduit 670. Although the inner diameter of the central aperture $D_{640a}$ and the inner diameter of the fluid discharge conduit 670 appear to be equal in FIG. 6, the inner diameter of treated fluid discharge conduit 670 can be either larger are smaller than $D_{640a}$. Such differences in diameter and/or the attachment of the vortex inducer 620 to the treated fluid discharge conduit 670 can be accommodated by any combination of piping, machined parts, welded connections, and/or fittings well known in the art. The upper end of the treated fluid discharge conduit 670 is physically connected to the upper end of the housing 680. The lower end of the separator apparatus 610, specifically the lower end of the solids collection conduit 650, is connected to the housing 680 at a location below the one or more inlet ports 681. Such connection of the separator apparatus 610, the treated fluid discharge conduit 670, and the housing 680 forms a feed chamber 682, which is fluidly connected to the exterior of the housing 680 through inlet ports 681, fluidly connected to the separation chamber 651 through the one or more helical apertures 622, and separated from the central aperture 621 by the treated fluid discharge conduit 670.

When in operation, untreated fluid 602 flows into downhole module 600 through one or more inlet ports 681 and then through one or more helical apertures 622. Upon exiting the one or more helical apertures 622, a vortex is created in separation chamber 651 wherein solids 603 are concentrated on the inner service of solids collection conduit 650 by centrifugal force while treated fluid 604 having a lower solids content are withdrawn from the separator apparatus through central aperture 621 and treated fluid discharge conduit 670.

Without wishing to be bound by any particular theory, it is believed that the section of solids collection conduit 650 identified by length $L_{650b}$ provides improved efficiency in removal solids since tangential velocity since remaining centrifugal force would have downward component in addition to a radial component due to the frustoconical shape of this section of solids collection conduit 650. Such component of downward force would promote discharge of solids from the lower end of solids collection conduit 650. In further embodiments, discontinuities are added to the inner surface of the sections of solids collection conduit 650 identified by length $L_{650a}$ and length $L_{650b}$, or a combination thereof. Such discontinuities include, but are not limited to, fins, ridges, channels, holes, or other surface discontinuities that serve to reduce tangential velocity of the solids and permit gravity to play a greater role in moving the solids downward and out of the solids collection chamber 650. Another advantage of this configuration is that channels 641 on the outer surface of core element 640 provide more improved access to surfaces to be machined.

Figure 7B:
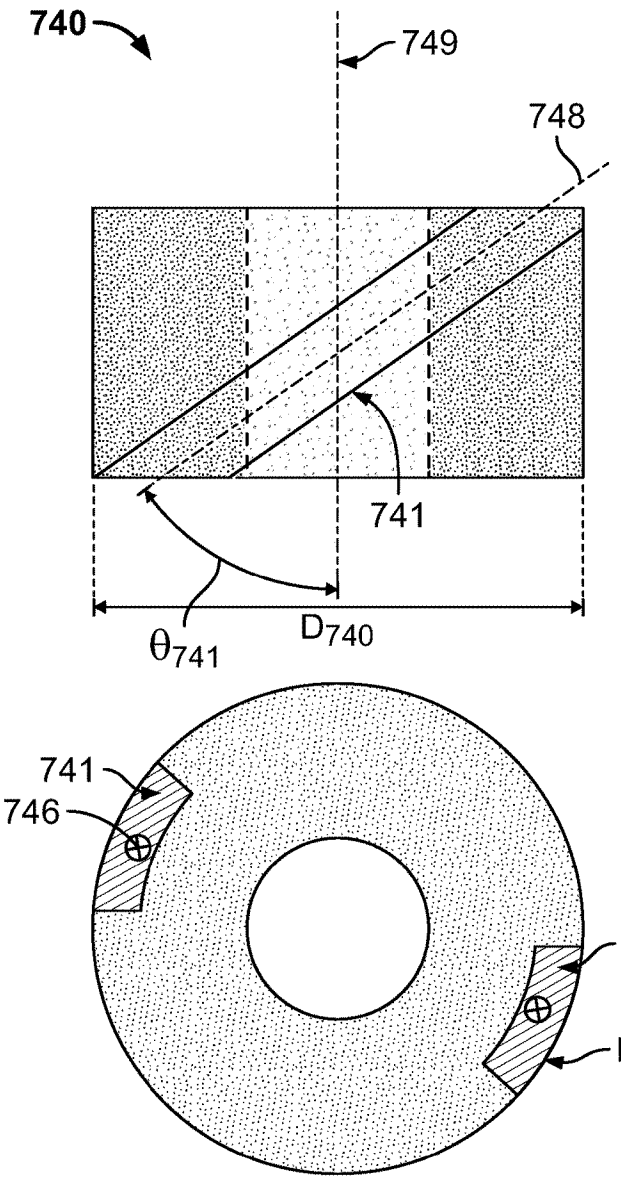
FIGS. 7A-7B are diagrams describing geometric features common to the embodiment types shown in FIGS. 1-6.
Figure 7A:
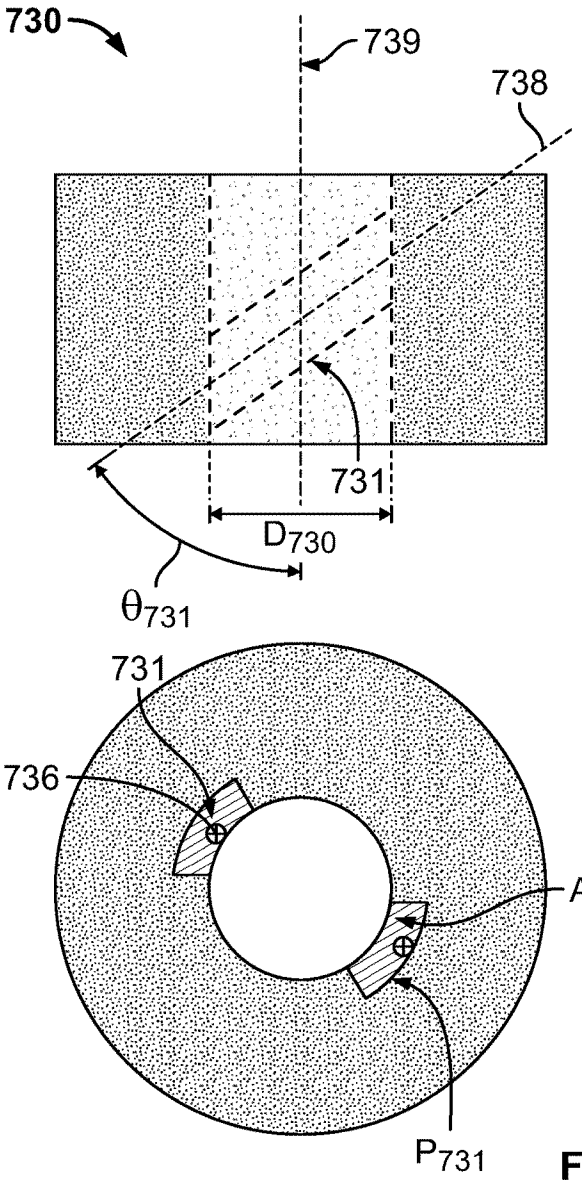

More detail of certain geometric features is shown in FIGS. 7A and 7B. FIG. 7A shows a side and top view of a simplified shell element 730 having two helical channels in the cylindrical inner surface. Simplified shell element 730 is functionally equivalent to shell elements 130, 330, and 530 as shown in FIGS. 1, 3, and 5, respectively. Central axis 739 is shown in the side view of simplified shell element 730 at the top of FIG. 7A. Inner diameter $D_{732}$ is the diameter prior to fabricating the helical channel 731. Area $A_{734}$ having centroid 736 is the area of the helical channel 731 when viewed from the top of shell element 730. Perimeter $P_{731}$ is the perimeter of the helical channel 731 when viewed from the top of shell element 730. For calculation of area $A_{734}$ and perimeter $P_{731}$, the "open" side of the helical channel 731 is assumed to be along the perimeter of inner surface of shell element 730 as this is equivalent to the helical aperture area and perimeter formed when the shell element is slidably engaged with the corresponding core element. A helical line is defined by the centroid 736 at every point along helical channel 731. Line 738 represents a line tangent to the aforementioned helical line, which in combination with the central axis defines the helix angle $\theta_{740}$. The helix lead or pitch is the axial distance between the centerline of adjacent coils of the helix or the axial length of a 360° section of the helix. The helix lead (L) is calculated as:

$$L = \frac{\pi D_{730}}{\tan\theta_{731}}$$

The flow area of each helical channel 731, as a precursor for each helical aperture, is the cross-sectional area of helical channel 731 perpendicular to the helical line formed by the centroid 736 of area $A_{731}$ at every point along helical channel 731. The flow area ($A_f$) is calculated as:

$A_f = A_{731} \sin \theta_{731}$

The velocity in the aperture formed by each helical channel 731, as a precursor for each helical aperture, is calculated as:

$$u = \frac{F}{n \times A_f}$$

wherein:

u is the flow speed of the fluid in meters/sec;

F is the design flow rate of the separator apparatus in meter$^3$/sec; and n is the number of helical apertures.

The flow perimeter of each helical channel, as a precursor for each helical aperture, is the perimeter of helical aperture to be formed by helical channel 731 perpendicular to the helical line formed by the centroid 736 of area $A_{731}$ at every point along helical channel 731. The flow perimeter ($P_f$) is calculated as:

$P_f = P_{731} \sin \theta_{731}$

The hydraulic diameter ($D_h$) of each helical aperture to be formed by helical channel 731, is calculated as:

$$D_h = \frac{4A_f}{P_f} = \frac{4A_{731}}{P_{731}}$$

FIG. 7B shows a side and top view of a simplified core element 740 having two helical channels in the cylindrical outer surface. Simplified core element 740 is functionally equivalent to core elements 240, 440, and 640 as shown in FIGS. 2, 4, and 6, respectively. Central axis 749 is shown in the side view of simplified core element 740 at the top of FIG. 7B. Outer diameter $D_{740}$ is the diameter prior to fabricating the helical channel 741. Area $A_{741}$ having centroid 746 is the area of the helical channel 741 when viewed from the top of core element 740. Perimeter $P_{741}$ is the perimeter of the helical channel 741 when viewed from the top of core element 740. For calculation of area $A_{741}$ and perimeter $P_{741}$, the "open" side of the helical channel 741 is assumed to be along the perimeter of inner surface of shell element 740 as this is equivalent to the helical aperture area and perimeter formed when the shell element is slidably engaged with the corresponding core element. A helical line is defined by the centroid 746 at every point along helical channel 741. Line 748 represents a line tangent to the aforementioned helical line, which in combination with the central axis defines the helix angle $\theta_{740}$. The helix lead or pitch is the axial distance between the centerline of adjacent coils of the helix or the axial length of a 360° section of the helix. The helix lead (L) is calculated as:

$$L = \frac{\pi D_{740}}{\tan\theta_{741}}$$

The flow area of each helical channel 741, as a precursor for each helical aperture, is the cross-sectional area of helical channel 741 perpendicular to the helical line formed by the centroid 746 of area $A_{741}$ at every point along helical channel 741. The flow area ($A_f$) is calculated as:

$$A_r = A_{741} \cos \theta_{741}$$

The velocity in the aperture formed by each helical channel 741, as a precursor for each helical aperture, is calculated as:

$$u = \frac{F}{n \times A_f}$$

wherein:

u is the flow speed of the fluid in meters/sec;

F is the design flow rate of the separator apparatus in meter$^3$/sec; and n is the number of helical apertures.

The flow perimeter of each helical channel, as a precursor for each helical aperture, is the perimeter of helical aperture to be formed by helical channel 741 perpendicular to the helical line formed by the centroid 746 of area $A_{741}$ at every point along helical channel 741. The flow perimeter ($P_f$) is calculated as:

$$P_f = P_{741} \cos \theta_{741}$$

The hydraulic diameter ($D_h$) of each helical aperture to be formed by helical channel 741, is calculated as:

$$D_h = \frac{4A_f}{P_f} = \frac{4A_{741}}{P_{741}}$$

In some embodiments, without wishing to be bound by any particular theory, Applicant believes that higher efficiencies are achieved by targeting an average velocity of greater than or equal to 50 feet/sec (15 meters/sec), 75 feet/sec (23 meters/sec), 100 feet/sec (31 meters/sec), 125 feet/sec (38 meters/sec), or 150 feet/sec (46 meters/sec), wherein the velocity is the calculated velocity in each of the one or more helical apertures based on a selected flow rate through the separator apparatus.

In some embodiments, without wishing to be bound by any particular theory, Applicant believes that higher efficiencies are achieved by targeting a Reynolds number of greater than or equal to 100,000, 200,000, 300,000, 400,000, or 500,000, wherein Reynolds number is calculated as:

$$\mathrm{Re} = \frac{\rho u L}{\mu}$$

wherein:

Re is the Reynolds number;

ρ is the density of the fluid;

u is the flow speed of the fluid;

L is the characteristic linear dimension;

μ is the dynamic viscosity of the liquid; and

Re is the calculated velocity in each of the one or more helical apertures based on a selected flow rate through the separator apparatus.

In some embodiments, for convenience, the fluid is assumed to be water at 77° F. (25° C.), resulting in ρ equal to 62.2 lbm/ft$^3$ (997 kg/m$^3$) and μ equal to $1.857\times10^{-5}$ lbf·s/ft$^2$ ($8.90\times10^{-4}$ Pa·s). L is the hydraulic diameter $D_h$ of each helical aperture, resulting in a Reynolds number calculated as:

$$\mathrm{Re} = \frac{(2.80 \times 10^6) \times F}{(n \times P_f)}$$

wherein:

n is the number of helical apertures on a vortex inducer;

$P_f$ is the perimeter of each helical aperture in meters; and

F is the design flow rate of the separator apparatus in meters/sec.

Figure 8A:
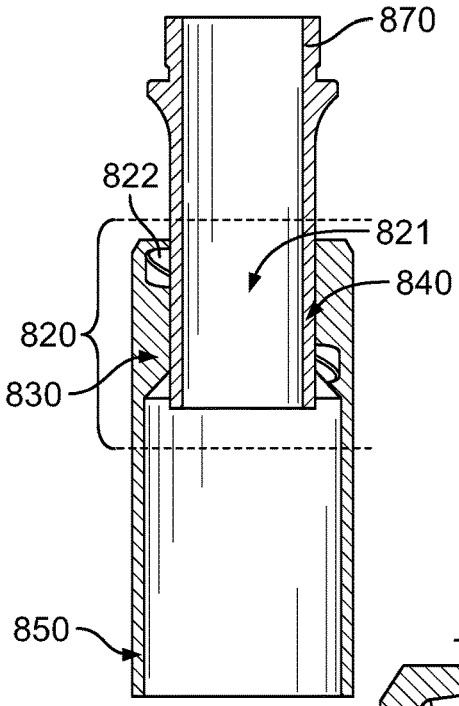
FIGS. 8A-8C are drawings from various perspectives showing geometric features of an embodiment of a vortex inducer having a single helical aperture formed from a helical channel on the inner surface of the shell element and the cylindrical outer surface of the core element.
Figure 8B:
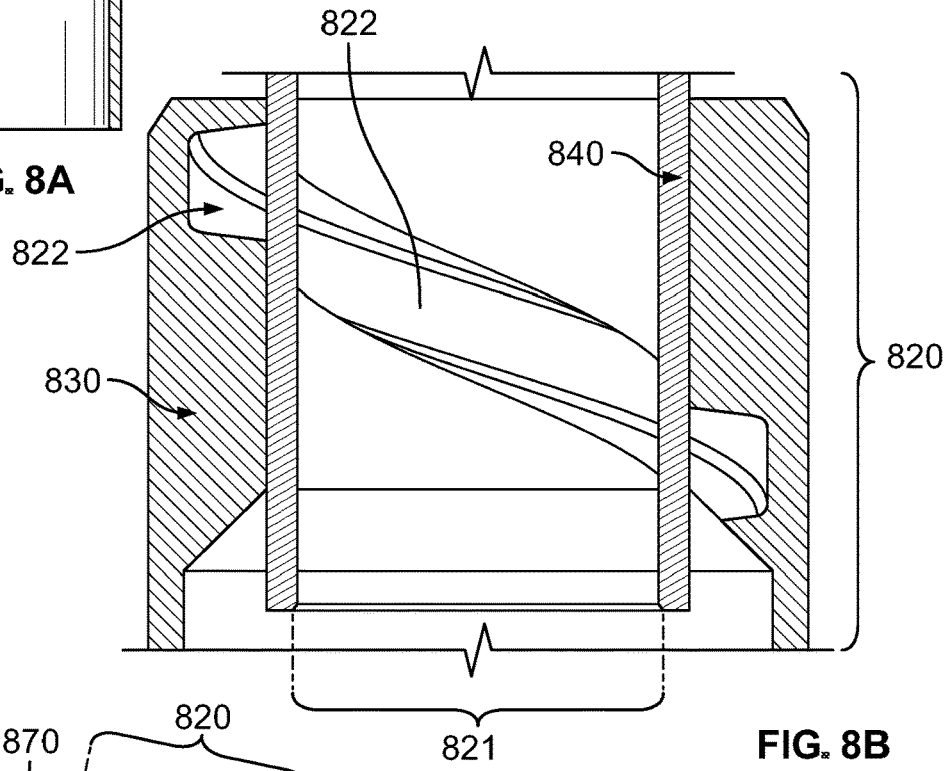
Figure 8C:
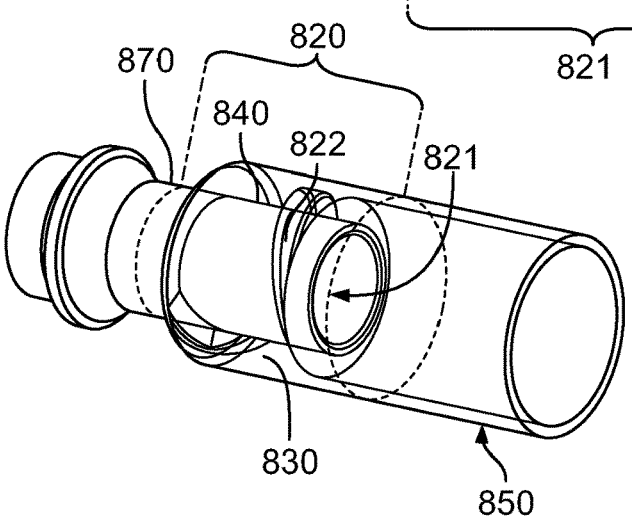

FIGS. 8A-8C show different views of an embodiment of a vortex inducer 820 having a central aperture 821 and a single helical aperture 822, analogous to the vortex inducers 120, 320, and 520, as shown in FIGS. 1, 3, and 5. The helical aperture 822 has a right-handed thread when viewed from the top of the vortex inducer 820. That is to say, when viewed from the top, clockwise travel through the helical aperture 822 would also include axial travel in the downward direction. The vortex inducer 820 comprises shell element 830 and core element 840. FIGS. 8A and 8C additionally show the connection of vortex inducer 820 to solids collection conduit 850 and treated fluids discharge conduit 870, wherein solids collection conduit 850 and shell element 830 are connected by fabrication from a single piece of metal, and core element 840 and treated fluids discharge conduit 870 are connected by fabrication from a single piece of metal. In other embodiments, one or both of these connections can be a threaded connection, a welded connection, a slidable connection with a set screw, or other connection means that provide a secure connection between the relevant elements of the downhole module during operation.

Figure 9A:
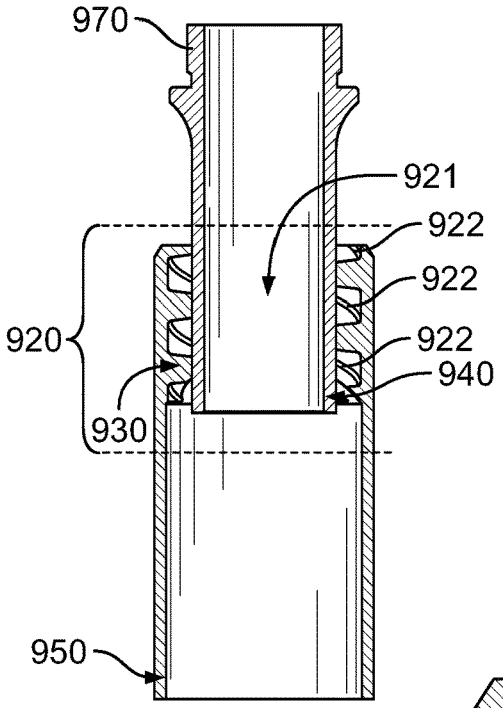
FIGS. 9A-9C are drawings from various perspectives showing geometric features of an embodiment of a vortex inducer having a plurality of helical apertures formed from a plurality of helical channels on the inner surface of the shell element and the cylindrical outer surface of the core element.
Figure 9B:
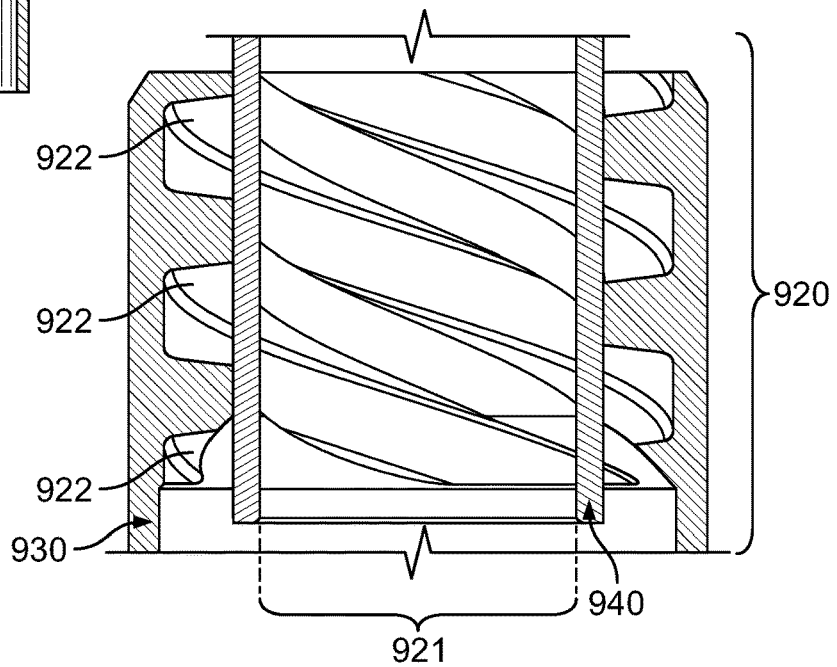
Figure 9C:
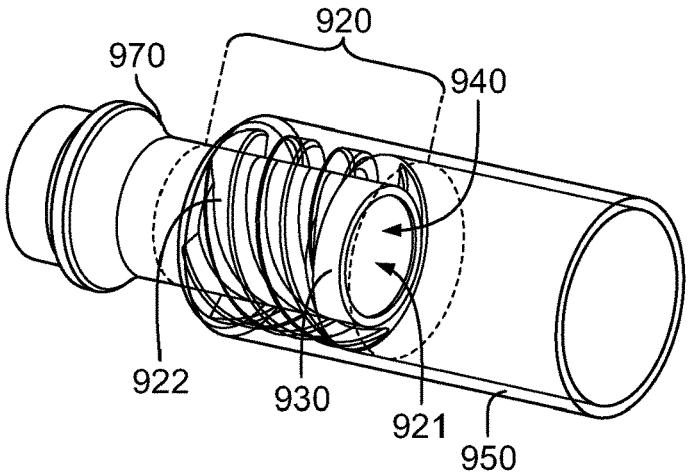

FIGS. 9A-9C show different views of an embodiment of a vortex inducer 920 having a central aperture 921 and three helical apertures 922, analogous to the vortex inducers 120, 320, and 520, as shown in FIGS. 1, 3, and 5. Each helical aperture 922 has a right-handed thread when viewed from the top of the vortex inducer 920. That is to say, when viewed from the top, clockwise travel through each helical aperture 922 would also include axial travel in the downward direction. The vortex inducer 920 comprises shell element 930 and core element 940. FIGS. 9A and 9C additionally show the connection of vortex inducer 920 to solids collection conduit 950 and treated fluids discharge conduit 970, wherein solids collection conduit 950 and shell element 930 are connected by fabrication from a single piece of metal, and core element 940 and treated fluids discharge conduit 970 are connected by fabrication from a single piece of metal. In other embodiments, one or both of these connections can be a threaded connection, a welded connection, a slidable connection with a set screw, or other connection means that provide a secure connection between the relevant elements of the downhole module during operation.

Figure 10A:
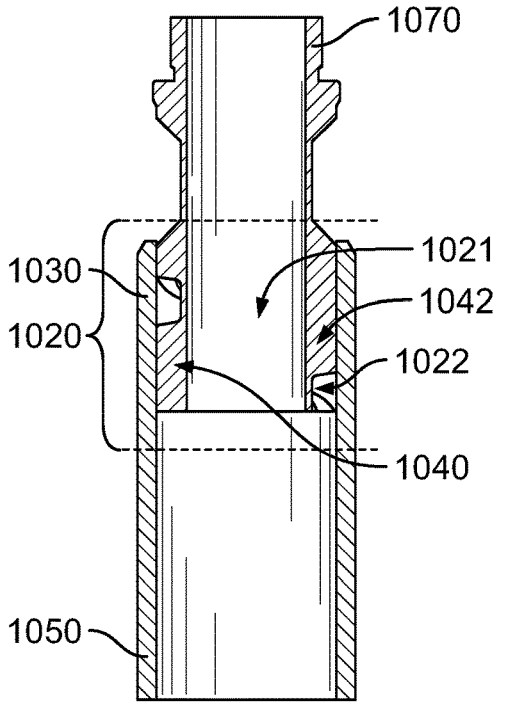
FIGS. 10A-10C are drawings from various perspectives showing geometric features of an embodiment of a vortex inducer having a single helical aperture formed from a helical channel on the outer surface of the core element and the cylindrical inner surface of the shell element.
Figure 10B:
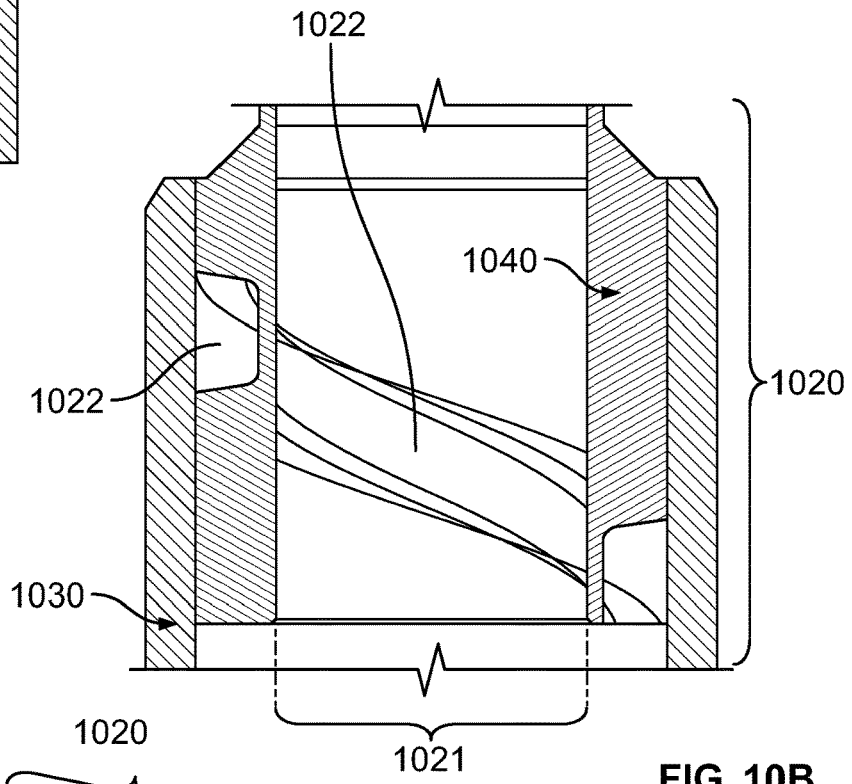
Figure 10C:
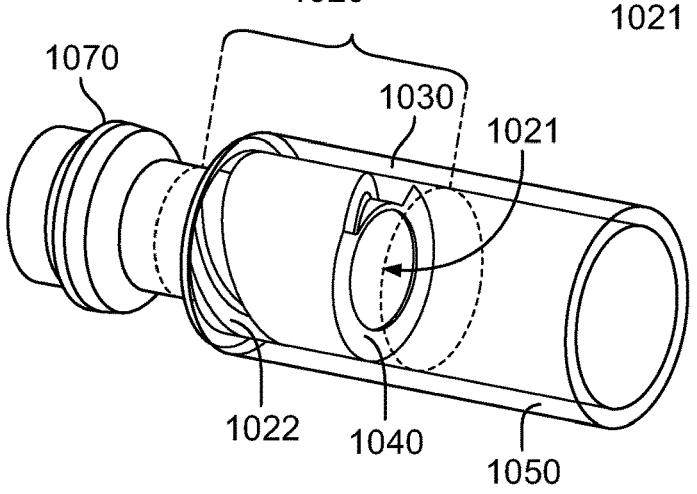

FIGS. 10A-10C show different views of an embodiment of a vortex inducer 1020 having a central aperture 1021 and a single helical aperture 1022, analogous to the vortex inducers 220, 420, and 620, as shown in FIGS. 2, 4, and 6. The helical aperture 1022 has a right-handed thread when viewed from the top of the vortex inducer 1020. That is to say, when viewed from the top, clockwise travel through the helical aperture 1022 would also include axial travel in the downward direction. The vortex inducer 1020 comprises shell element 1030 and core element 1040. FIGS. 10A and 10C additionally show the connection of vortex inducer 1020 to solids collection conduit 1050 and treated fluids discharge conduit 1070, wherein solids collection conduit 1050 and shell element 1030 are connected by fabrication from a single piece of metal, and core element 1040 and treated fluids discharge conduit 1070 are connected by fabrication from a single piece of metal. In other embodiments, one or both of these connections can be a threaded connection, a welded connection, a slidable connection with a set screw, or other connection means that provide a secure connection between the relevant elements of the downhole module during operation.

Figure 11A:
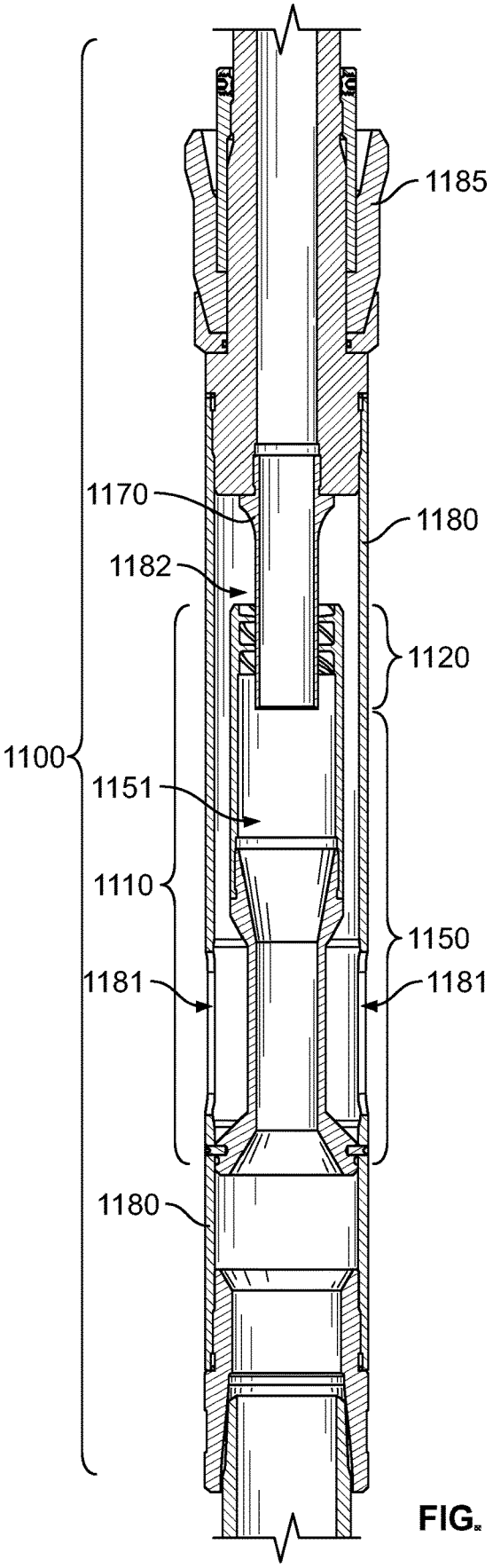
FIGS. 11A and 11B are drawings of a downhole module comprising the separator apparatus disclosed herein and a downhole module installed at the termination of downhole piping.
Figure 11B:
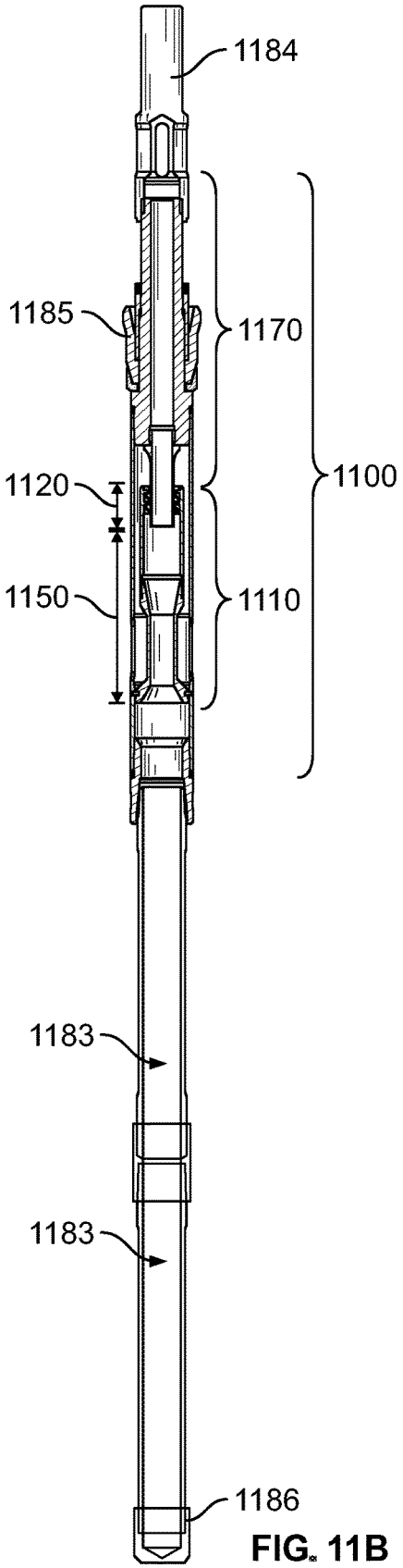

FIGS. 11A and 11B show different views of an embodiment of a downhole module 1100 having a separator apparatus 1110 analogous to separator apparatus 110, as shown in FIG. 1. Vortex inducer 1120, solids collection conduit 1150, separation chamber 1151, treated fluids discharge 1170, housing 1180, inlet ports 1181, and feed chamber 1182 are analogous to vortex inducer 120, solids collection conduit 150, separation chamber 151, treated fluids discharge 170, housing 180, inlet ports 181, and feed chamber 182, respectively, as shown in FIG. 1. One or more housing extensions 1183 are optionally added below the housing 1180 to provide more capacity for storage of solids removed from untreated fluid by separator apparatus 1110. Piping 1184 leads to the suction side of a pump for transporting treated fluids to the surface. A seal between the housing 1180 and a well casing is provided by a standard cup packer fitting 1185. Optional plug 1186 is shown connected to the lower end of housing extension 1183.

Figure 12:
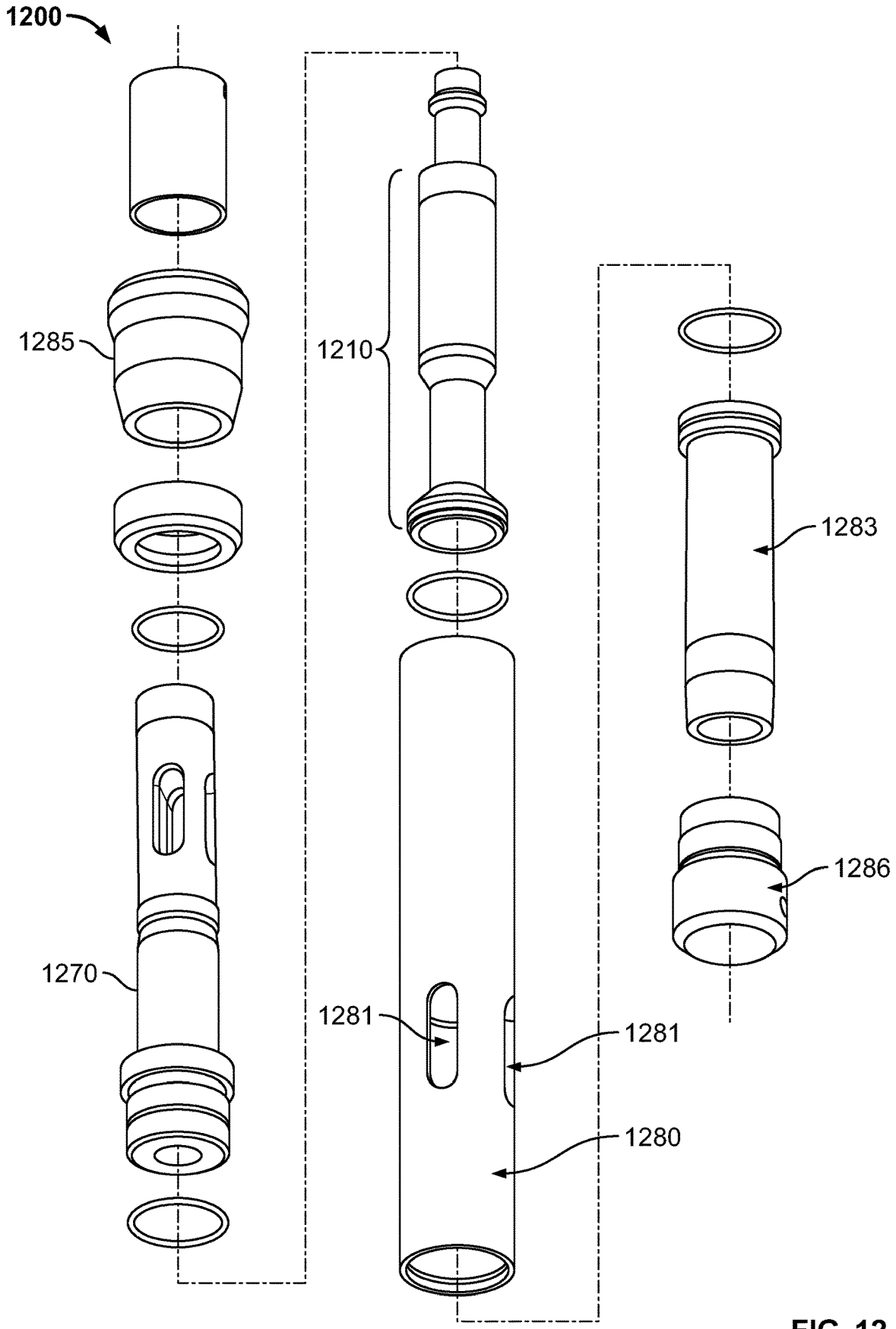
FIG. 12 shows an expanded view of a downhole module.

FIG. 12 shows an expanded view of downhole module 1200 and certain components thereof shown in FIGS. 11A and 11B. Separator apparatus 1210 analogous to separator apparatus 1110, as shown in FIG. 11. Separator apparatus 1210, treated fluid discharge conduit 1270, housing 1280, inlet ports 1281, optional housing extension 1283, and cup packer fitting 1285 are analogous to separator apparatus 1120, treated fluid discharge conduit 1170, housing 1180, inlet ports 1181, optional housing extension 1183, and cup packer fitting 1185, respectively, as shown in FIG. 11. Optional lower housing closure or plug 1286 for containment of collected solids is also shown. It can be seen in FIG. 12 that many additional fittings and connections can optionally be present in downhole module 1200 in support of the operability of separator apparatus 1210.

Although the present invention and its advantages have been described in detail, it should be understood that various changes, substitutions and alterations can be made herein without departing from the spirit and scope of the invention as defined by the appended claims. For the sake of brevity, only certain ranges are explicitly disclosed herein. However, in addition to recited ranges, any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, within a range includes every point or individual value between its end points even though not explicitly recited. Thus, every point or individual value may serve as its own lower or upper limit combined with any other point or individual value or any other lower or upper limit, to recite a range not explicitly recited.

All patents, test procedures, and other documents cited in this application are fully incorporated herein by reference for all jurisdictions in which such incorporation is permitted. Moreover, the scope of the present application is not intended to be limited to the particular embodiments of the processes, machines, means, methods, and/or steps described in the specification. As one of the ordinary skill in the art will readily appreciate from the disclosure of the present invention, processes, machines, means, methods, and/or steps, presently existing or later to be developed that perform substantially the same function or achieve substantially the same result as the corresponding embodiments described herein, may be utilized according to the present invention. Accordingly, the appended claims are intended to include within their scope such processes, machines, means, methods, and/or steps.

What is claimed is:

1. A separator apparatus for removing solids from an untreated fluid, the separator apparatus comprising:

a vortex inducer, comprising one or more helical apertures and a central aperture; and a solids collection conduit, connected to the vortex inducer to form a separation chamber;

wherein:

the one or more helical apertures are positioned for delivering a helical flow of an untreated fluid to the separation chamber proximate to the inner surface of the solids collection conduit; and the central aperture is positioned for withdrawing a treated fluid from the separation chamber proximate to a central axis of the separation chamber.

2. The separator apparatus of claim 1, wherein:

the vortex inducer comprises a shell element and a core element; and the one or more helical apertures are at an interface between a cylindrical inner surface of the shell element and a cylindrical outer surface of the core element.

3. The separator apparatus of claim 2, wherein:

the cylindrical outer surface of the core element is radially spaced from the central aperture;

the cylindrical inner surface of the shell element comprises one or more helical channels;

the core element is slidably joined to the shell element by an overlap of at least a portion of the cylindrical outer surface of the core element and at least a portion of the cylindrical inner surface of the shell element; and the one or more helical apertures are formed proximate to the overlap by the one or more helical channels and the cylindrical outer surface of the core element.

4. The separator apparatus of claim 2, wherein:

the cylindrical outer surface of the core element is radially spaced from the central aperture and comprises one or more helical channels;

the core element is slidably joined to the shell element by an overlap of at least a portion of the cylindrical outer surface of the core element and at least a portion of the cylindrical inner surface of the shell element; and the one or more helical apertures are formed proximate to the overlap by the one or more helical channels and the cylindrical inner surface of the shell element.

5. The separator apparatus of claim 1, wherein each helical aperture has a uniform cross-sectional area perpendicular to a helical line passing through the centroid of the cross-sectional area of each helical aperture.

6. The separator apparatus of claim 5, wherein a line tangent to the helical line forms a helix angle θ with the central axis of the vortex inducer in the range of from 10° to 80°.

7. The separator apparatus of claim 5, wherein the uniform cross-sectional area is sized to produce a velocity in the one or more helical apertures of at least 15 meters/sec at a design flow rate of the separator apparatus.

8. The separator apparatus of claim 5, wherein the uniform cross-sectional area is sized to produce a Reynolds number in the one or more helical apertures of at least 100,000 at a design flow rate of the separator apparatus.

9. The separator apparatus of claim 2, wherein one or more of the core element, the shell element, and the solids collection conduit have:

a) a surface with a Rockwell C hardness of greater than or equal to 30;

b) a surface with a Brinell hardness of greater than or equal to 285;

c) a surface with a Vickers hardness of greater than or equal to 300;

d) a tensile strength (yield) of greater than or equal to 965 MPa; or e) a combination thereof.

10. The separator apparatus of claim 2, wherein one or more of the core element, the shell element, and the solids collection conduit are fabricated from stainless steel.

11. The separator apparatus of claim 2, wherein one or more of the core element, the shell element, and the solids collection conduit have one or more wear surfaces having a ceramic coating.

12. A downhole module comprising:

a housing; and the separator apparatus of claim 1, mounted within the housing forming an upper space within the housing and above the separator apparatus and a lower space within the housing and below the separator apparatus;

an upper housing closure; and a treated fluid discharge conduit, connected to the vortex inducer at its lower end and the upper housing closure at its upper end;

wherein:

the treated fluid discharge conduit fluidly connects the central aperture to an opening in the upper housing closure;

the upper housing closure, the treated fluid discharge conduit, and the separator apparatus are connected forming a feed chamber; and the feed chamber is fluidly connected to the one or more helical apertures and one or more inlet ports through the housing.

13. A method for separating solids from an untreated fluid, the method comprising:

submerging the downhole module of claim 12 in an untreated fluid having a first solids content; and reducing the pressure inside the treated fluid discharge conduit relative to the pressure outside the downhole module to induce flow of untreated fluid through the one or more inlet ports to the feed chamber, and from the feed chamber through the vortex inducer to the separation chamber, wherein:

the flow of untreated fluid through the vortex inducer creates a velocity of untreated fluid in the one or more helical apertures, wherein the velocity has a tangential component and an axial component; and the tangential component of velocity of untreated fluids exiting the one or more helical apertures creates a vortex in the separation chamber wherein centrifugal force concentrates solids proximate to the inner surface of the solids collection conduit and creating a treated fluid having a second solids content proximate to the central axis of the separation chamber, wherein the second solids content is less than the first solids content.

14. The method of claim 13, further comprising withdrawing the treated fluid through the treated fluid discharge conduit.

15. The method of claim 13, further comprising withdrawing the concentrated solids from the solids collection conduit through gravity and/or the axial component of velocity.

16. The method of claim 13, wherein the velocity is sufficient to produce a ratio of the second solids content to the first solids content of less than or equal to 0.05.

17. An apparatus for separating solids from fluids, the apparatus comprising a vortex inducer physically connected to a solids collection conduit, forming a chamber, wherein the vortex inducer comprises a helical aperture and a central aperture, and the chamber is fluidly connected to the helical aperture and the central aperture, wherein the chamber receives a helical flow from the helical aperture.

* * * * *